US010955168B2

(12) United States Patent
Warren et al.

(10) Patent No.: US 10,955,168 B2
(45) Date of Patent: Mar. 23, 2021

(54) METHODS SYSTEMS AND DEVICES FOR CONTROLLING TEMPERATURE AND HUMIDITY USING EXCESS ENERGY FROM A COMBINED HEAT AND POWER SYSTEM

(71) Applicant: Enginuity Power Systems, Inc., Alexandria, VA (US)

(72) Inventors: James Warren, Alexandria, VA (US); Gregory Powell, Rockville, MD (US)

( * ) Notice: Subject to any disclaimer, the term of this patent is extended or adjusted under 35 U.S.C. 154(b) by 0 days.

(21) Appl. No.: 16/875,963

(22) Filed: May 15, 2020

(65) Prior Publication Data

US 2020/0348045 A1 Nov. 5, 2020

Related U.S. Application Data

(63) Continuation-in-part of application No. 16/818,009, filed on Mar. 13, 2020, which is a continuation of application No. 15/974,679, filed on May 8, 2018, now Pat. No. 10,605,483, which is a continuation-in-part of application No. 15/621,711, filed on Jun. 13, 2017, now Pat. No. 10,337,452.

(51) Int. Cl.

| | |
|---|---|
| ***F24H 1/20*** | (2006.01) |
| ***F24H 1/18*** | (2006.01) |
| ***F24H 1/52*** | (2006.01) |
| ***F24H 9/18*** | (2006.01) |
| ***F24H 9/00*** | (2006.01) |

(52) U.S. Cl.

CPC ..... *F24H 1/208* (2013.01); *F24H 1/186* (2013.01); *F24H 1/52* (2013.01); *F24H 9/0084* (2013.01); *F24H 9/1836* (2013.01); *F24H 2240/01* (2013.01); *F24H 2240/06* (2013.01)

(58) Field of Classification Search

CPC . F24H 1/208; F24H 1/186; F24H 1/52; F24H 9/0084; F24H 9/1836; F24H 2240/01; F24H 2240/06

See application file for complete search history.

(56) References Cited

U.S. PATENT DOCUMENTS

| | | | | |
|---|---|---|---|---|
| 1,230,617 A | | 6/1917 | Still | |
| 3,723,027 A | * | 3/1973 | Montelius | F04D 29/669 417/313 |
| 4,657,290 A | * | 4/1987 | Linden | F02G 5/02 290/2 |
| 4,736,111 A | * | 4/1988 | Linden | F02B 63/04 290/2 |
| 6,966,185 B2 | * | 11/2005 | Shimada | F02G 5/04 60/698 |

(Continued)

FOREIGN PATENT DOCUMENTS

| | | |
|---|---|---|
| DE | 41 37 517 | 5/1993 |
| GB | 2 500 440 | 9/2013 |
| WO | WO 2005/026511 | 3/2005 |

OTHER PUBLICATIONS http://energyefficientdesiccant.blogspot.com/2013/06/commercial-desiccant-dehumidifier.html.

https://www.rehobothsystems.com/industrial-desiccant-dehumidifier-1257334.html.

*Primary Examiner* — Shafiq Mian

(74) *Attorney, Agent, or Firm* — Capitol Patent & Trademark Law Firm, PLLC

(57) ABSTRACT

A combined heat and power system generates energy and efficiently captures a percentage of such energy that would otherwise be lost to, among other things, control the temperature and humidity of a house or dwelling.

18 Claims, 9 Drawing Sheets

(56) References Cited

U.S. PATENT DOCUMENTS

| | | | | |
|---|---|---|---|---|
| 2002/0095939 | A1 | 7/2002 | Gordon et al. | |
| 2002/0153127 | A1* | 10/2002 | Togawa | F02G 5/02 165/51 |
| 2004/0221823 | A1 | 11/2004 | Warren | |
| 2007/0101716 | A1* | 5/2007 | Tafas | F01K 23/10 60/618 |
| 2008/0060589 | A1* | 3/2008 | Carney | B60L 1/003 123/41.31 |
| 2009/0295157 | A1* | 12/2009 | Yuri | F24D 19/1009 290/2 |
| 2011/0041784 | A1 | 2/2011 | McAlister | |
| 2013/0047639 | A1 | 2/2013 | Stannard et al. | |
| 2013/0139507 | A1 | 6/2013 | Morse | |
| 2015/0292434 | A1* | 10/2015 | Yamanaka | F02B 63/04 60/670 |
| 2016/0230643 | A1* | 8/2016 | Honda | F01P 9/02 |
| 2017/0356310 | A1 | 12/2017 | Powell et al. | |
| 2018/0119578 | A1* | 5/2018 | Zhou | F01K 23/065 |

* cited by examiner

METHODS SYSTEMS AND DEVICES FOR CONTROLLING TEMPERATURE AND HUMIDITY USING EXCESS ENERGY FROM A COMBINED HEAT AND POWER SYSTEM

RELATED APPLICATION

This application is a continuation-in-part of U.S. patent application Ser. No. 16/818,009 filed Mar. 13, 2020, (the "'009 Application"), which is a continuation of U.S. patent application Ser. No. 15/974,679 filed May 8, 2018 ("'679 Application) which, in turn, is a continuation-in-part of U.S. application Ser. No. 15/621,711 filed Jun. 13, 2017 (the "'711 Application"). This application is also related to U.S. patent application Ser. No. 16/795,750 (the "'750 Application") filed Feb. 20, 2020. The disclosures of the '009, '679, '711 and '750 Applications are hereby fully incorporated herein by reference for all purposes as if each were set forth in full herein.

FIELD

The present invention relates generally to a combined heat and power system that stores, captures, and utilizes excess energy generated by an engine for a variety of applications.

BACKGROUND

A continuing challenge is to economically provide energy while yet reclaiming various aspects of the energy development such as heat. Yet another challenge is to reduce carbon emissions when operating combustion engines to produce energy such as electrical energy. Oftentimes, heat generated by combustion within the engine is wasted. Furthermore, challenges such as packaging and engine efficiency remain as design concerns in the development of combined heat and power systems.

Other challenges include complying with the relevant EPA or other environmental regulatory references when providing in-home or in-dwelling engines used to power a combined heat and power system. Accommodating all of these concerns within one energy unit remains an ongoing challenge.

The '750, '679 and '711 Applications along with U.S. Provisional Patent Application No. 62/349,346 filed on Jun. 13, 2016 ("'346 Application") and U.S. Provisional Patent Application No. 62/419,188 ("'188 Application") having a filing date of Nov. 8, 2016 may describe certain aspects related to the technological field of the present invention that could be helpful in understanding the invention and their disclosures are incorporated in their entirety as though fully disclosed herein.

For example, during operation of a combined heat and power system or device described in the above-referenced applications a substantial amount of excess energy may be captured; energy that would otherwise be lost.

It is desirable to provide methods and devices for utilizing the energy captured by a combined heat and power system or device, for example, by utilizing such energy to control the temperature and/or humidity of a house or dwelling.

SUMMARY

The above-referenced challenges are resolved by embodiments of the present invention. Unique methods, systems and devices that control the temperature and/or humidity of a dwelling or house using excess energy produced by a combined heat and power system are described herein, among other methods, systems and devices.

One such system may comprise an energy generation sub-system comprising; (i) a replaceable engine connected to one or more generators and a turbo-generator, the engine and one or more generators operable to generate energy in the form of electricity, heat and exhaust gases, and provide a first amount of the energy (e.g., electricity) to an energy storage sub-system as needed, and a vessel for storing liquid heated by the heat from the engine and one or more generators; (ii) an energy distribution sub-system comprising; coils operable to circulate coolant heated coolant by energy received from the energy generation sub-system, and fans operable to direct air over the heated coils to heat the directed air, and to distribute the heated air; and (iii) a humidity control sub-section operable to (i) control temperature and humidity of air circulating within a dwelling or house based on energy transferred from the heated liquid or circulated coolant or (ii) control a discharge of a second amount of energy (e.g., waste heat) from the heated liquid or circulated coolant.

One exemplary humidity control sub-section may comprise a by-pass valve, first and second external heat exchangers, a humidity control element, fans and a heat pump, among other components.

The exemplary system may further comprise controls that are operable to send one or more control signals to the humidity control sub-section in order to: (i) control the temperature or humidity of air circulating within a dwelling or house; or (ii) control the temperature and humidity of the air circulating within the dwelling or house based on the energy transferred from the heated liquid or circulated coolant; (iii) control a discharge of a second amount of energy (e.g., waste heat) from the heated liquid or circulated coolant; (iv) control a by-pass valve in order to initially direct the heated liquid or circulated coolant to a first or second external heat exchanger; (v) control a humidity control element; (vi) control one or more fans and a heat pump.

In another embodiment, an exemplary, inventive system may further comprise an energy storage sub-system operable to receive and store a first amount of energy (e.g., electricity). One example of an energy storage sub-system may be a battery or battery pack that is operable to discharge stored energy to the energy distribution sub-system or to an electrical utility grid.

In addition to inventive systems and devices the inventors provide exemplary methods. One such method may comprise generating electricity, heat and exhaust gases from an energy generation sub-system that comprises a replaceable engine connected to one or more generators and a turbo-generator, and providing a first amount of the energy (e.g., electricity) to an energy storage sub-system as needed; storing liquid heated by the heat from the engine and one or more generators in a vessel; circulating heated coolant heated by received energy from the energy generation sub-system using coils; directing air over the heated coils to heat the directed air, and distributing the heated air; and controlling a temperature or humidity of air circulating within a dwelling or house based on energy transferred from the heated liquid or circulated coolant or controlling a discharge of a second amount of the energy from the heated liquid or circulated coolant.

Such an exemplary method may further comprise sending one or more control signals to a humidity control sub-section to: (i) control the temperature or humidity of the air circulating within the dwelling or house based on the energy transferred from the heated liquid or circulated coolant; (ii) control the temperature and humidity of air circulating within a dwelling or house based on the energy transferred from the heated liquid or circulated coolant; (iii) control the discharge of a second amount of energy (e.g., waste heat) from the heated liquid or circulated coolant; (v) control a by-pass valve that is operable to initially direct the heated liquid or circulated coolant to a first or second external heat exchanger; (vi) to a humidity control element to control the element; (vi) to one or more fans and a heat pump to control the fans and heat pump.

Additionally, such a method may further comprise receiving and storing a first amount of energy (e.g., electricity) in an energy storage sub-system as needed, where the energy storage sub-system may comprise a battery, and where the method may yet further comprise discharging stored energy from the battery to the energy distribution sub-system or to an electrical utility grid from the battery.

Still further, an exemplary method that includes a combined heat and power system may further comprise adding moisture to air circulating within a dwelling or house to humidify the air.

BRIEF DESCRIPTION OF THE DRAWINGS

The invention will be described in more detail below on the basis of one or more drawings, which illustrates exemplary embodiments.

DETAILED DESCRIPTION OF THE EMBODIMENTS

Figure 1:
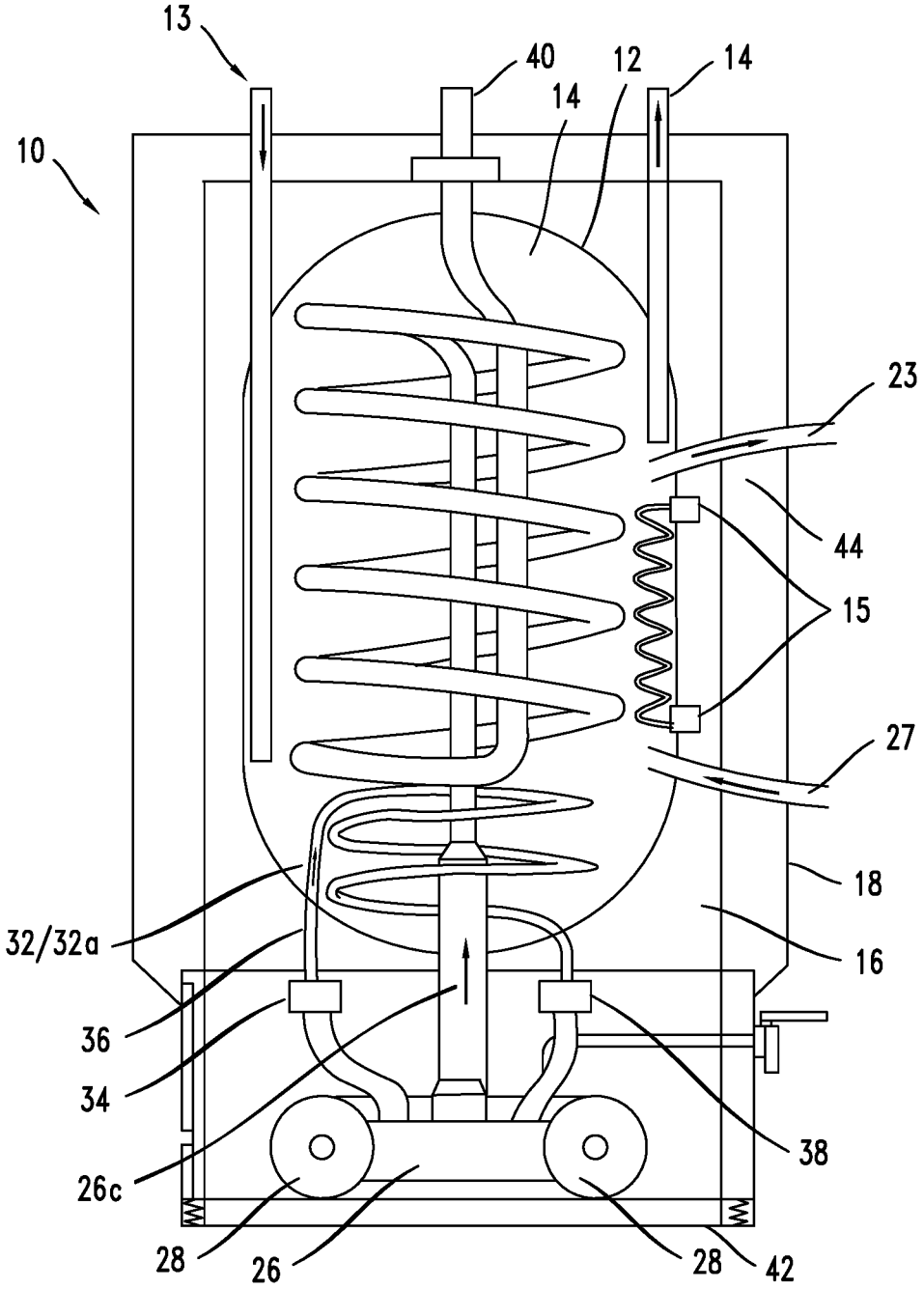
FIG. 1 illustrates an exemplary combined heat and power system in accordance with an embodiment of the present invention.

To the extent that any of the figures or text included herein depicts or describes dimensions, temperature levels, humidity levels, sound levels, power levels, gas levels (e.g., oxygen, toxic exhaust gases), efficiencies or other levels or operating parameters it should be understood that such information is merely exemplary to aid the reader in understanding the embodiments described herein. It should be understood, therefore, that such information is provided to enable one skilled in the art to make and use an exemplary embodiment of the invention without departing from the scope of the invention.

It should be understood that, although specific exemplary embodiments are discussed herein, there is no intent to limit the scope of the present invention to such embodiments. To the contrary, it should be understood that the exemplary embodiments discussed herein are for illustrative purposes, and that modified and alternative embodiments may be implemented without departing from the scope of the present invention. Exemplary embodiments of methods and devices for controlling the humidity in combined heat and power systems and devices are described herein and are shown by way of example in the drawings. Throughout the following description and drawings, like reference numbers/characters refer to like elements.

It should also be noted that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed and may also include additional steps not included in a description of the process/method.

As used herein, the term "and/or" includes any and all combinations of one or more of the associated listed items. As used herein, the singular forms "a," "an" and "the" are intended to include the plural form, unless the context and/or common sense indicates otherwise.

As used herein "operable to" means—functions to—unless the context, common sense or the knowledge of one skilled in the art dictates otherwise.

It should be understood that the word "coolant" includes water and other similar liquids (e.g., ethylene glycol or propylene glycol) or liquid mixtures (e.g., water and ethylene glycol or propylene glycol) that are typically used to cool engine parts.

As used herein the phrase "energy" may include one or more of the following depending on the context in which this phrase is used: thermal energy, radiant energy, chemical energy, electrical energy, and motion energy.

As used herein the designations "first", "second", "third", "fourth" etc., are purely to distinguish one value, amount or component from another and does not indicate an importance, priority or status. In fact, the values, amounts and components could be re-designated (i.e., re-numbered) and it would not affect the methods, systems or devices provided by the present invention.

It should be understood that when the description herein describes the use of controls that such controls may include one or more components such as a thermostat, a so-called "smart thermostat", thermometer, humidity controls, temperature. pressure and humidity sensors, oxygen sensors, toxic exhaust gas sensors and/or an electronic controller that may be included in, or combined with, one or more of the just stated components where the controller may include one or more elements. For example, the controller may comprise one or more electronic processors and memories. The processors may be operable to execute stored, specialized instructions for completing features and functions described herein (e.g., temperature and humidity level computations). Such instructions may be stored in an onboard memory, in separate memory, or in a specialized database for example. Such instructions represent processes, functions and features that have been integrated into memory as stored electronic signals.

As used herein, the term "embodiment" and/or "exemplary" refers to an example of the present invention.

Referring to FIG. 1, an energy recovery system 10 may include an engine 26 that produces heat in both the exhaust stream and in a coolant stream, the features of which may be described in more detail in the '711 Application (now issued as U.S. Pat. No. 10,337,452) incorporated by reference herein. A housing 18 contains a first pressure vessel 12 containing a first fluid or liquid 14, such as water. A second pressure vessel 16 also contains a second fluid or liquid such as water. The second vessel 16 may be a boiler formed such as described in U.S. Pat. Nos. 8,763,564 or 9,303,896, for example, the teachings of which are herein incorporated by reference as if fully stated herein. The first vessel or boiler 12, which in one embodiment may be formed as a hot water tank in a known manner, is surrounded by the second vessel 16, and is actually immersed within the fluid of the second vessel 16. The second vessel 16 or hot water storage tank, may be formed as a hot water tank in a known manner, and in this embodiment may comprise a cold-water inlet 22 and a hot water outlet 24. An exemplary replaceable engine 26, such as a four-stroke opposed piston engine as described below but not restricted to that design, is also contained within the housing 18 but not within either pressure vessel 12, 16, and provides energy to produce electricity. One or more generators, and in this embodiment at least one generator 28, may be combined with the engine 26 in a known way, and when combined may form an exemplary "genset" 26/28, as schematically shown in FIG. 1. In the embodiment depicted in FIG. 1 the genset comprises a dual generator 26/28 in accordance with the present invention. In accordance with embodiments of the invention, the combination of the engine 26 and one or more generators 28 may be operable to generate energy in the form of electricity, heat and exhaust gases, and provide a first amount of the energy (e.g., electricity) to an energy storage sub-system (e.g., batter 218 in FIG. 2) as needed.

It has been found that the efficiencies presented by the novel genset 26/28 described in FIG. 1 (as well as other figures) provides synergistic efficiencies with regard to recovering heat from the operation of the genset 26/28 that would otherwise be lost or "wasted" using traditional, non-inventive designs. It should be noted that although the engine 26 or genset 26/28 is depicted at the bottom of the system 10, this is merely exemplary. The engine 26 or genset 26/28 may be positioned elsewhere, such as at the top of such a system (see FIG. 3) for example.

Figure 3:
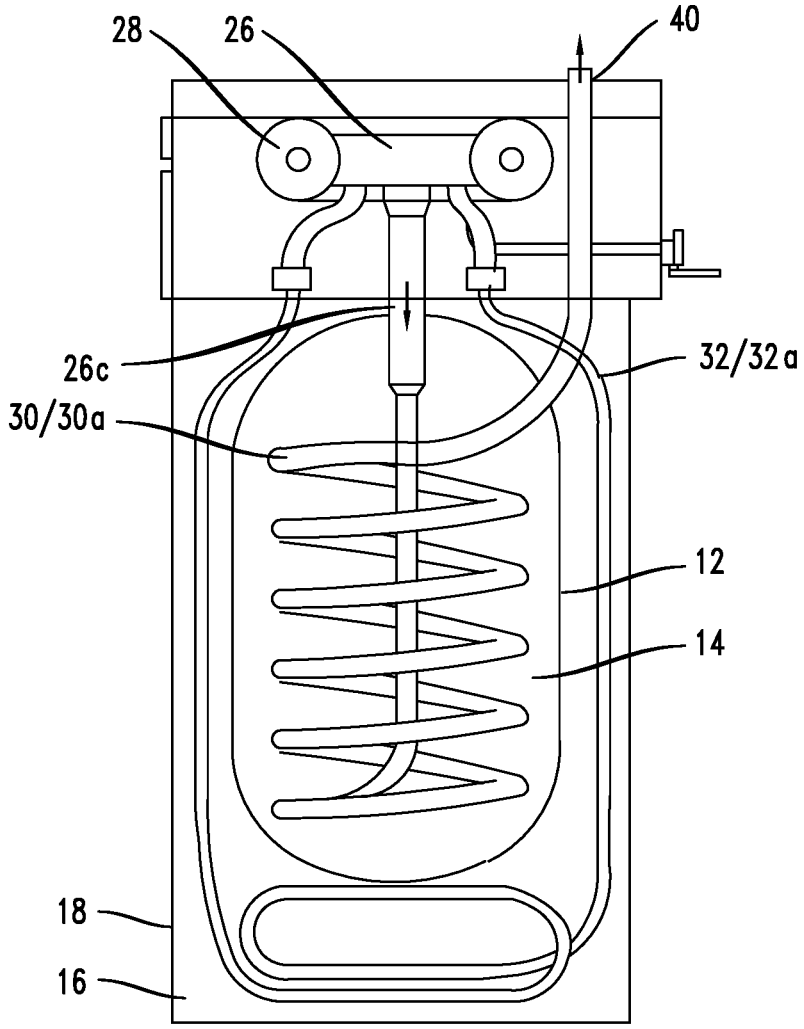
FIG. 3 illustrates yet another exemplary combined heat and power system in accordance with an embodiment of the present invention.

In accordance with embodiments of the present invention, the engine 26 and the one or more generators (e.g., generator 28) produce heat that is directed from the engine 26 through an engine exhaust vent or duct during operation of the engine 26, as exhaust 26*c*. To capture this heat, and prevent it from becoming waste heat, a first internal heat exchanger 30 (see FIG. 3) may be used. In an embodiment, the heat exchanger 30 may be configured within the first storage tank/pressure vessel 12 and fluidly communicate with the engine 26 such that exhaust 26*c* is directed from the engine 26 through the first internal heat exchanger coil 30*a* as shown in FIG. 3, and then out a vent 40 from the housing 20. The first internal heat exchanger coil 30*a* may be formed from a thermally conductive material such as a metal, stainless steel for example, that thermally conducts heat into the fluid or water of the first storage tank/pressure vessel 12 allowing the vessel 12 to store liquid heated by the heat from the engine 26 and generator(s) 28. To further capture the heat from the engine 26, for example, a second internal heat exchanger 32 may be used. In an embodiment the second internal heat exchanger 32 may be configured within the second storage tank/pressure vessel 16, and fluidly communicate with the engine 26 whereby engine coolant is directed through the second internal heat exchanger coil 32*a*. The second internal heat exchanger coil 32*a* may be formed from a thermally conductive material such as a metal, copper or brass for example. As shown in FIG. 1, a compressor 34 may be connected to a coolant outlet and a coolant inlet on the engine, such that heated coolant 36 may be pumped from the engine 26, compressed and further heated, and then passed through the second internal heat exchanger 32 within the second pressure vessel 16. As the coolant passes through the second heat exchanger 32, the coolant is cooled to transfer heat to the second fluid, water, or liquid within the second pressure vessel 16 to allow the vessel to store liquid heated by the coolant. Once the coolant 36 has travelled through the second heat exchanger 32, and prior to the coolant 36 being reintroduced into the engine 26, the coolant 36 may be passed through an expander valve 38 to thereby expand the coolant 36 to an even cooler state as it reenters the engine 26 through coolant inlet. Also shown is a hot fluid exit 23 from vessel 12 and a cooled fluid inlet 27 to vessel 12, representing a closed loop to a furnace and associated heat exchanger, for example. In more detail, upon recovering heat from the coolant and exhaust systems, heated water in the vessel 12 may be used by an external heat exchanger (discussed elsewhere herein), for example, and then returned to the vessel 12. Accordingly, the present system recovers heat from both the exhaust and coolant systems of an engine and generator(s).

Unless otherwise stated herein, such as with the details of the four-stroke opposed-piston engine or with the details of the heat exchangers 30 and 32, the combined heat and power (CHP) system shown in FIG. 1 may be constructed as known in the art. Accordingly, U.S. Pat. Nos. 9,617,897, 9,097,152, 6,823,668, 7,021,059, and 7,574,853 are instructional and are herein incorporated by reference in their entireties. Further, U.S. Patent Publication Nos. 2016/0194997, 2009/0205338, and 2013/0247877 are instructional and are herein incorporated by reference in their entireties. Finally, EP2503110 and WO 2011/028401 are also instructional, and are herein incorporated by reference in their entireties.

As shown in FIG. 1, the exhaust from the first internal heat exchanger may be vented from the boiler or first vessel 12 through a boiler exhaust. As the water is heated within the water storage tank or first vessel 12, hot water 14 is pumped out to provide hot water for a variety of applications, and cold makeup water 13 may be introduced into the water storage tank or first vessel 12. As also schematically shown in FIG. 1, a controller 15, in conjunction with one or more sensors (not shown in Figures) may comprise controls for controlling the temperature and pressure of the water 14 in the hot water tank 12, and in the boiler 16. Accordingly, the operation of the engine 26 may be coordinated with the controller 15 by increasing or decreasing the engine operating cycles/minute, respectively. An outer housing 44 is preferably formed about the combined heating and power system 10, thereby forming a soundproof enclosure.

As also schematically shown in FIG. 1, the combined system 10 may contain a suspension or dampening system 42 to mitigate the effects of the vibration of the engine 26 in the home or office for example. Related thereto, vibration-resistant couplings for the intake, radiator, exhaust, and fuel supply of the engine 26 may also be integrated into the dampening system 42 as schematically shown in FIG. 1.

Figure 2:
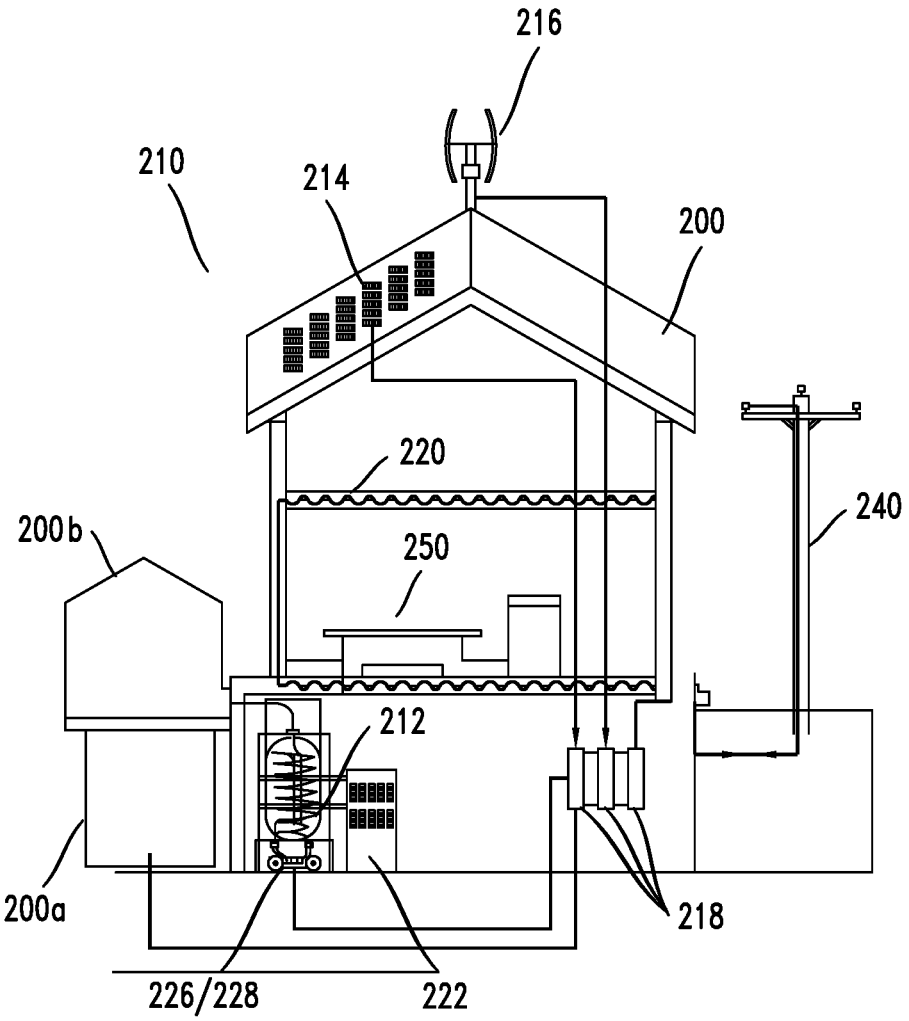
FIG. 2 illustrates application of reclaimed heat of the combined heat and power system of FIG. 1 in accordance with an embodiment of the present invention.

Referring now to FIG. 2, there is depicted an exemplary combined heat and power system 210 that is operable to provide a first amount of energy, such as electricity, that may be used to power various equipment 250 around a dwelling or house 200, including driveway 200*a* and a greenhouse 200*b*. As also shown, hot water from the hot water tank 212 may be used to heat the dwelling 200 through radiant floor heaters 220, and/or to augment the heat provided by a furnace 222 through heat exchange at the furnace 222, and/or to heat a pool (not shown), among other hot water applications, including supplying heat that can be used to supply hot water throughout the house 200, for example. Other energy collectors, such as solar panels 214 that provide photovoltaic energy, wind turbines 216 that provide rotary power, and so forth may be integrated to form a total energy storage system.

In an embodiment, excess energy from the engine/generator or genset 226/228, the solar panels 214, and the wind turbine 216 may be stored in an energy storage sub-system 218, such as battery pack for example. Furthermore, excess energy may be sold back to the existing power grid 240 as needed. Similar to the embodiments described previously, it has been found that the efficiencies presented by the novel genset 226/228 provides synergistic efficiencies with regard to recovering energy (e.g., waste heat) through the present energy recovery system, environmental advantages, and packaging efficiencies.

Figure 4:
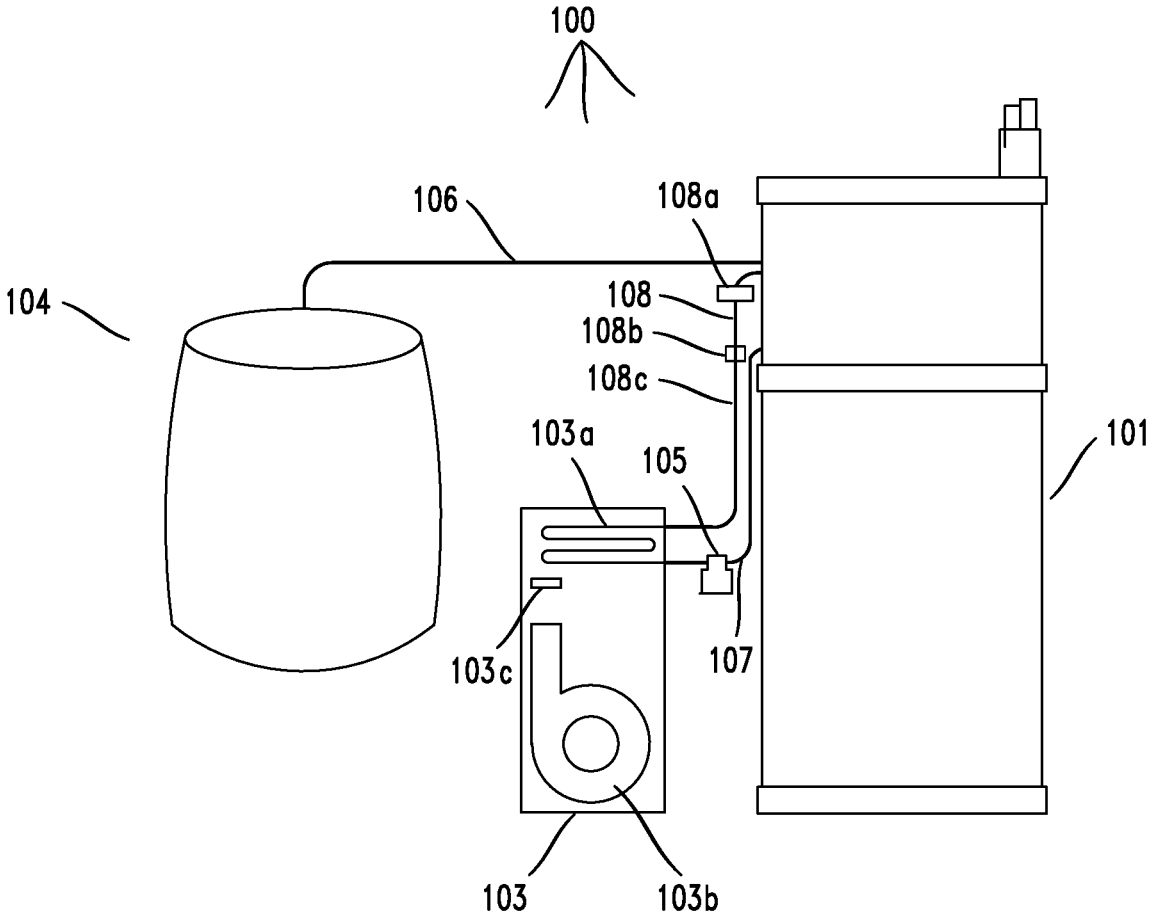
FIG. 4 depicts an exemplary combined heat and power system that comprises energy storage and distribution capabilities.

Referring now to FIG. 4, there is depicted an exemplary, combined heat and power system 100 in accordance with an embodiment of the invention.

As depicted the system 100 may include a plurality of sub-systems, such as an energy generation sub-system 101, an energy distribution sub-system 103 and an energy storage sub-system 104. In an embodiment, the energy distribution sub-system 103 may comprise an air handling sub-system while the energy storage sub-system 104 may comprise a battery or battery pack, for example (e.g., exemplary capacity 6 kilowatts to 20 kilowatts).

In an embodiment, the energy generation sub-system 101 may be operable to generate energy through the operation of an engine described elsewhere herein as well as in the U.S. Pat. No. 10,337,452. In an embodiment, the energy generated by the sub-system 101 may be used to generate power (e.g., electricity), and/or heat water, for example. Further, as explained in more detail herein, the sub-system 101 may be operable to capture or re-capture (collectively "capture") some of the energy used to generate power (e.g., electricity) and heat water, for example.

As depicted, provided the energy generation sub-system 101 has a connected energy source (e.g., natural gas), the sub-system 101 may generate electricity, and provide the electricity to a dwelling or house, such as dwelling 200 in FIG. 2, In addition, sub-system 101 may be operable to provide a first amount of energy to the energy storage sub-system 104 (e, g., one or more batteries) in order to charge or re-charge (collectively "charge") the sub-system 104. Upon receiving the energy from sub-system 101, the sub-system 104 may be operable to store the first amount of energy and, when desired, discharge the stored energy at a later time to provide power to sub-system 103, for example, or back to an electrical utility grid.

In an embodiment, the energy distribution sub-system 103 may be operable to function in combination with, or independently of, the sub-system 101.

For example, in one scenario the energy generating sub-system 101 may comprise a replaceable engine 128 connected to power a plurality of generators 128*a,b* and a turbo-generator 128*c* (see FIG. 5) operable to generate electricity that may be provided to a house or dwelling 200, for example, shown in FIG. 2. However, as noted elsewhere herein, as the engine 128 (and generators to some extent) is operating it also generates a substantial amount of energy (heat) that, in traditional systems would not be used (i.e., it would be wasted). In embodiments of the invention, such waste heat may be captured and used to heat a liquid (e.g. water) stored within a hot water storage tank or vessel 120 (see FIG. 5) within sub-system 101 or be further provided to the energy distribution sub-system 103 to provide heated air to the dwelling or house 200.

In more detail, and as explained elsewhere herein, heat in the form of (i) exhaust gases output from the engine 128 upon burning an energy source and (ii) heated coolant may flow away from the engine 128 and its surrounding area and eventually be fed to the vessel 120 (see FIG. 5) and sub-system 103. Thus, heat that would normally be lost is captured and used to heat water in the vessel 120, and provide heat to the dwelling or house 200, among other things.

In an embodiment, the temperature of vessel 120 may be monitored by controls (not shown in FIG. 5, but see element 15 in FIG. 1) to ensure that the temperature and pressure of the vessel 120 does not rise above a certain variable thresholds. In one example, such a variable temperature threshold may comprise a temperature between 140° F. and 160° F.

In an embodiment, the controls may be operable to determine that the temperature or pressure of the water 120*a* within the vessel 120 is approaching or at a certain vessel threshold. Accordingly, controls may send electrical or electronic signals via wired or wireless channels to a pump 108*a* and by-pass valve 108*b* (see FIG. 4) to open the by-pass valve and to direct heated coolant within piping 132 (see FIG. 5) that would otherwise flow through water 120*a* within vessel 120 to sub-system 103 via piping 108*c*. Thus, by re-directing the heated coolant away from the vessel 120, the water within vessel 120 will begin to cool.

Upon receiving the heated coolant via piping 108*c*, the sub-system 103 may be operable to direct the heated coolant within piping 108*c* to coils 103*a*. The coils 103*a* are operable to circulate coolant heated by energy received from the energy generation sub-system 101, and as the coolant is circulating, fans 103*b* within the sub-system 103 may be operable to direct air over the now heated coils to cool the coils and the coolant inside the coils. Conversely, the heated coolant (e.g., water) inside the coils 103*a* functions to heat the directed air, and to distribute the heated air flowing across the coils 103*a*.

In an embodiment where the dwelling or house 200 desires heating, the now heated air that was directed over the coils may be forced, through the operation of fans 103*b* out of the sub-system 103 into conduits or other ventilation equipment to be distributed throughout the house or dwelling 200.

Thus, in this embodiment, the heat within the coolant that is sent to the sub-system 103 can be captured and distributed by the sub-system 103 to further warm the house or dwelling 200. However, in the event that the dwelling or house 200 is not in need of heated air, the heated air may be discharged to the exterior of the dwelling or house 200 via means known in the art or in accordance with inventive methods and sub-sections described elsewhere herein.

Yet further, as indicated above the heated coolant may traverse through coils 103*a* and be cooled by the air flowing across the coils 103*a*. In an embodiment, the now cooled coolant may be output from the sub-system 103 via output piping 107 and sent to (i.e., returned to) the sub-system 101 and, particular, sent to the vessel 120 and piping 132 at a reduced temperature (e.g. 100° F.). In FIG. 4, the sub-system 103 is depicted as including a pump 105 that may be operable to apply a pressure to the cooled water exiting the sub-system 103 via piping 107 so as to return the water to the sub-system 101 under an acceptable pressure.

In the above scenarios, the sub-systems 101,103 work in combination to, for example, control the operating temperature of the vessel 120, and to provide energy (heat) from the vessel 120 that can be distributed to the dwelling or house 200 by the sub-system 103.

In alternative embodiments, each of the sub-systems 101, 103 may operate independently of one another.

For example, sub-system 103 may comprise temperature controls 103*c* that are operable to control the "on" and "off" operation of sub-system 103 independent of the operation of sub-system 101. Said another way, controls 103*c* may be operable to control whether sub-system 103 provides forced heated air to the dwelling or house 200. In more detail, in one embodiment the controls 103*c* may comprise sensors (not shown in figures) operable to detect the temperature of the air within dwelling or house 200. If the temperature detected by the sensors falls below a dwelling threshold temperature (e.g., 65° F.), then the sensors may send signals to the controls 103*c* via wired or wireless means that, in turn, send signals to the fan(s) 103*b* to turn the fans "on" and force heated air into the air distribution system of the dwelling or house 200 to warm the house, for example. Conversely, once the temperature of the air within the dwelling or house 200 detected by the sensors rises to meet, or exceed, a dwelling threshold (the same or a different threshold), then the sensors may send signals to the controls 103*c* that, in turn, send signals to the fans 103*b* to turn the fans "off" and which prevents heated air from entering the air distribution system of the dwelling or house 200. In the scenario just described, the sub-system 103 operates independently of the subsystem 101 because its operation is not dependent upon the operation of the sub-system 101 (e.g., not dependent upon the temperature of the vessel 120).

Yet further, in an embodiment, when sub-system 103 is operating but the engine 128 and generators 128*a,b* of sub-system 101 are not operating, the energy storage sub-system 104 may be operable to provide energy (e.g. electricity) to the sub-system 103 in order to power the fans 103*b* while the vessel 120 via piping 108 may be operable to provide heated water to coils 103*a* of sub-system 103. Accordingly, fans 103*b* may operate to force air over coils 103*a* to provide heat to the dwelling or house 200.

The discussion above highlights just a few of many possible scenarios where the sub-systems 101,103 may work in combination or independently of one another.

Figure 5:
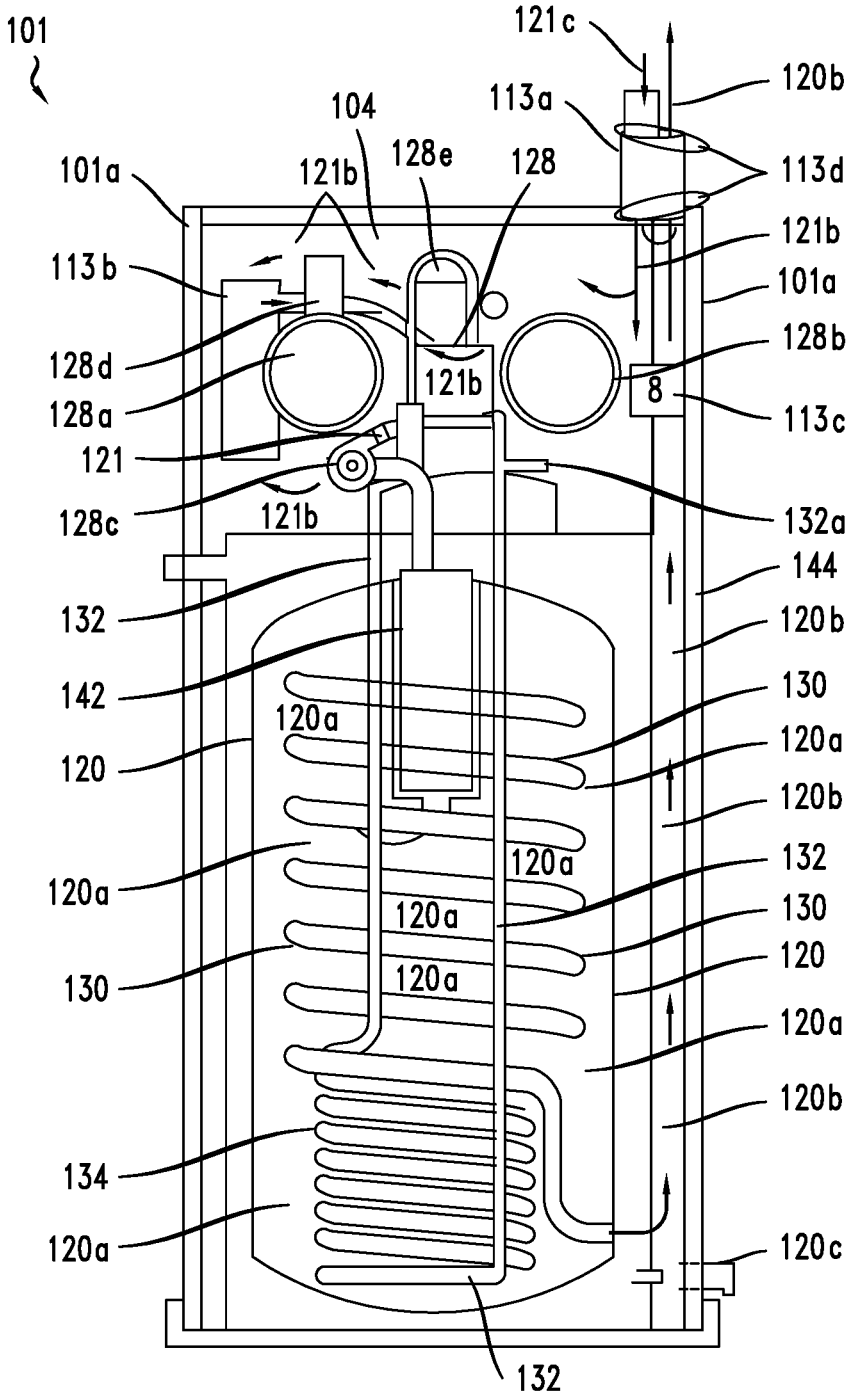
FIG. 5 depicts a cross-sectional view of an exemplary energy generation sub-system of an exemplary combined heat and power system in accordance with an embodiment of the present invention.

Referring now to FIG. 5 there is depicted a detailed view of an exemplary, energy generating sub-system 101 according to an embodiment of the invention. As shown, the energy generating sub-system 101 may comprise the aforementioned replaceable engine 128 connected to generators 128*a, b*, where each generator 128*a,b* may be operable to generate energy in the form of electricity. The sub-system 101 may also include an additional generator—turbo-generator 128*c*—along with muffler and catalytic converter unit 142, storage vessel 120, exhaust heat exchanger 130 (e.g. coils), coolant heat exchanger 134 (e.g., coils), intake air filtration unit 113*b*, and thermo-acoustical insulation 144 among other elements. In an embodiment, the muffler and catalytic converter unit 142, exhaust heat exchanger 130 and coolant heat exchanger 134 may be embedded within the vessel 120 in order to transfer heat from such components to liquid (e.g., water) inside the vessel 120 in order to capture energy in the form of heat from operation of the engine 128.

Exemplary details of the structure, features and functions of the engine 128 is set forth elsewhere herein as well as in the U.S. Pat. No. 10,337,452. Presently the discussion that follows will focus on the operation of the engine 128 in combination with the other elements of the sub-system 101. However, before continuing it should be noted that in embodiments, "quick connect/disconnect hardware" (not shown in figures) may be included within sub-system 101 to facilitate easy removal of the engine 128 from the sub-system 101 or, conversely, to secure the engine 128 to the sub-system 101.

In more detail, in one embodiment the engine 128 may be attached to a tray by means of pins (not shown in figures) operable to slide out to facilitate complete removal of the engine 128 from the sub-system 101 when service requires that work be performed that is beyond what is possible in the field. In addition to these methods, wiring harnesses connected to the engine 128 or the generators 128*a,b* may comprise a pin-and-socket configuration that function to be easily separated by an individual in the field using existing tools. The combination of these features results in an engine 128 that can be replaced within hours, for example, when necessary.

In an embodiment, during operation the engine 128 and generators 128*a,b* may be operable to produce so-called "waste heat". One such source of waste heat is exhaust gas (hereafter referred to as "exhaust") that is directed from the engine 128 to an exhaust pipe 121 and eventually to turbo-generator 128*c*. Further, additional waste heat may be created within and on the surface of the engine 128. In embodiments, the sub-system 101 may be configured to capture substantially all sources of such waste heat.

Turning first to the exhaust, in an embodiment the turbo-generator 128*c* may be operable to (i.e. function to) receive the exhaust and convert the exhaust to an additional electricity amount (e.g., 1-2 kilowatts) over and above the electricity generated by generators 128*a,b*.

In an embodiment, the turbo-generator 128*c* may be configured to be located at the output of the exhaust piping 121, substantially close to the output of the engine 128, in order to maximize the conversion of exhaust from the engine 128 into electricity. Accordingly, the length of the exhaust piping 121 may be configured to be a length that allows for such maximized conversion. In an example, the length of the exhaust piping 121 may be (e.g., 1 to 3 inches).

In embodiments, the turbo-generator 128*c* may be further configured to be positioned at a location to convert exhaust energy into electricity prior to the exhaust contacting the muffler-catalytic converter unit 142, That is to say, the turbo-generator 128*c* may be positioned between the engine 128 and unit 142. This configuration functions to protect the muffler-catalytic converter unit 142 from damage due to the extremely high-temperatures of the exhaust that is output from the engine, thus extending the life of the unit 142.

For example, the exhaust may exit an exhaust manifold (not shown in FIG. 5) of the engine 128 at approximately 1,600° F. At this temperature the exhaust may damage elements of the catalytic converter within unit 142. Accordingly, to prevent such damage, the inventors provide embodiments that place the turbo-generator 128*c* in between the unit 142 and the engine 128. Unlike the catalytic converter within unit 142, the turbo-generator 128*c*, may be operable to receive the exhaust at this temperature without being damaged. Accordingly, the exhaust may flow through vanes (not shown) of the turbo-generator 128*c*.

Upon exiting the turbo-generator 128*c*, the temperature of the exhaust is approximately 1,200° F. as it flows to the muffler/catalytic converter unit 142. Accordingly, in one embodiment the temperature and pressure of the exhaust may be reduced by passing the exhaust through the turbo-generator 128*c* prior to passing to the unit 142. It should be noted that while temperatures at 1,500° F. may damage elements of the catalytic converter within unit 142, catalytic converters provided by the present invention may operate without risk of damage between 600 and 1,200° F., with an optimal temperature of 800° F.

In sum, in embodiments of the invention elements of the catalytic converter in unit 142 may be configured to be positioned within a distance from the engine 128 where the temperature of the exhaust optimizes the operation of such elements.

Figure 6A:
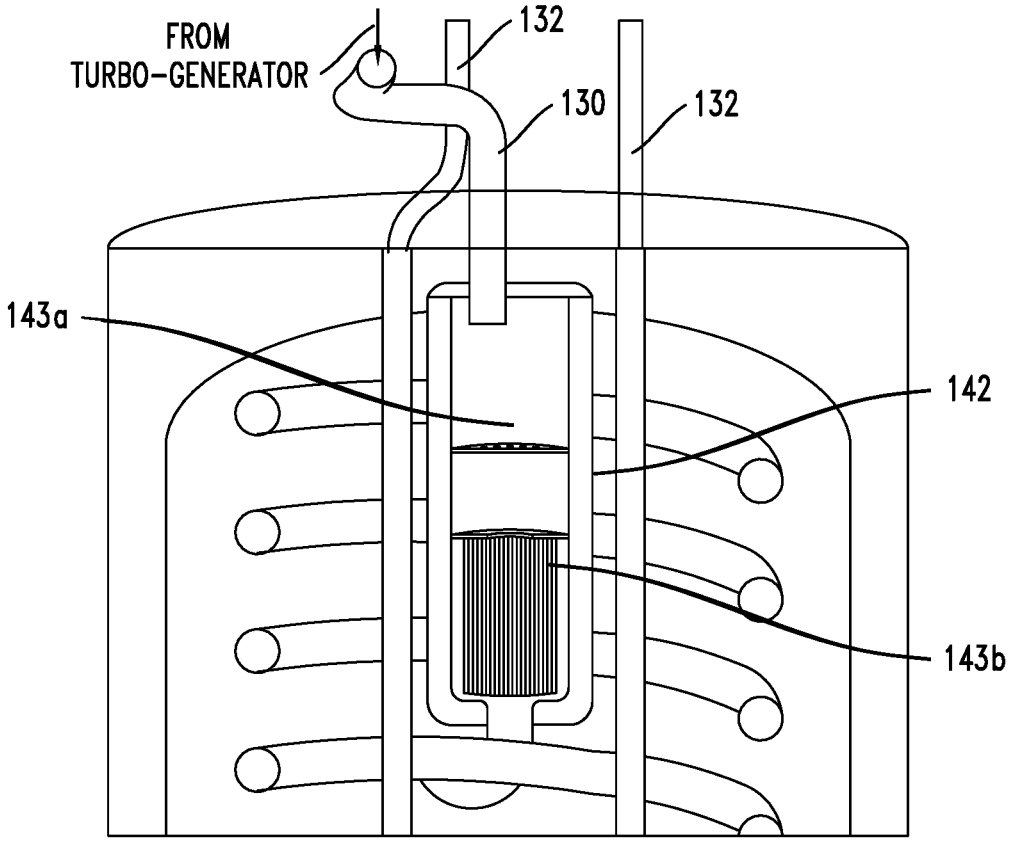
FIG. 6A depicts an enlarged view of a portion of the exemplary energy generation sub-system shown in FIG. 5 in accordance with an embodiment of the present invention.

Referring now to FIG. 6A, there is depicted an enlarged view of an exemplary muffler-catalytic converter unit 142. Upon receiving the exhaust, the catalytic converter section 143*a* of unit 142 ("converter" for short) may be operable to convert toxic gases (e.g. oxides of nitrogen (NOx), carbon monoxide) in the exhaust to substantially non-toxic gases (nitrogen, hydrocarbons, carbon dioxide) as well as convert the exhaust into additional heat that may be absorbed by the water 120*a* in the vessel 120 surrounding the converter in unit 142. In an embodiment, section 143*a* may comprise a ceramic structure having layers coated with one or more of a metal catalyst, such as platinum, rhodium and/or palladium, for example. As exhaust enters converter 143*a*, it may impact a first so-called "reduction" layer comprising platinum and rhodium. This layer functions to reduce NOx in the exhaust by converting NO or NO2 molecules in the exhaust to nitrogen. Thereafter, the exhaust may impact a second or "oxidation" layer comprising palladium or platinum that functions to reduce unburned hydrocarbons and carbon monoxide through oxidization (burning) to carbon dioxide and water, for example.

In some embodiments the unit 142 may further comprise an oxygen sensor (e.g., see element 245 in FIG. 6B) that may be operable to detect a level of oxygen in the exhaust and send signals to controls (not shown in figures) in order to ensure that a proper stoichiometric balance of treated exhaust is achieved and maintained to ensure appropriate reduction of toxic gases within the exhaust. These controls may share some of the same elements (e.g., electronic controllers) as the temperature and pressure controls previously described.

In an embodiment, the converter 143*a* may be configured as honeycombed layers or layers of ceramic beads, for example.

After the exhaust is treated in converter 143*a* it may flow to the muffler section 143*b* ("muffler"). In an embodiment, the muffler 143*b* may be operable to reduce a level of sound generated by the engine 128 and exhaust gases, for example, to less than 60 dB. Such sound reduction is desirable in order to place the system 100 within a house or dwelling 200. Said another way, absent the muffler 143*b*, the engine 128 may generate sound at a level that would be irritating to the inhabitants or occupants of the house or dwelling 200. Further sound reduction may be achieved by embedding the muffler 143*b* within the storage vessel 120 such that any sound that is not reduced by the muffler 143*b* may be dampened or otherwise reduced by the water within the vessel 120, In an embodiment the level of sound escaping the vessel 120 may be less than 60 dB, for example. Yet further, because the muffler 143*b* is configured within the vessel 120 it is less likely to be exposed to conditions (air) that would lead to its corrosion. Thus, it is expected that the useful life of the muffler is lengthened by embedding it within vessel 120. In an embodiment, the muffler 143*b* may be made from a stainless steel, for example.

As mentioned previously the unit 142 may be embedded within the vessel 120 in order to transfer heat from the exhaust and components of the unit 142 to the water 120*a* in order to capture energy in the form of heat from the exhaust. It should be noted that when the converter 143*a* that is a part of unit 142 is so embedded, the temperature of the converter 143*a* may eventually equal the temperature of the water 120*a* inside the vessel 120. In an embodiment, this allows the converter 143*a* to be more efficient than existing converters. In more detail, during operation of the engine 128 the temperature of the water 120*a* in the vessel 120 may be in the range of 100° to 160° F. Accordingly, the embedded converter 143*a* will be at the same temperature at some point (or, at least a higher temperature than ambient). In an embodiment, the converter 143*a* may be operable to reach an optimum operating performance once it has reached an optimum operating temperature. Accordingly, because the temperature of embedded converter 143*a* may be maintained at an elevated temperature the converter 143*a* may reach (and maintain) an optimum operating temperature more quickly than converters that are not so embedded. In an embodiment, because the converter 143*a* can operate at an optimum operating temperature it may be able to more effectively remove toxic gases and elements from the exhaust within piping 130.

In an embodiment, the unit 142 may be configured to be easily replaceable. For example, in one embodiment the unit 142 may be replaced by removing some or all of the exhaust heat exchanger 130 and lifting the unit 142 out of the sub-system 101.

Figure 6B:
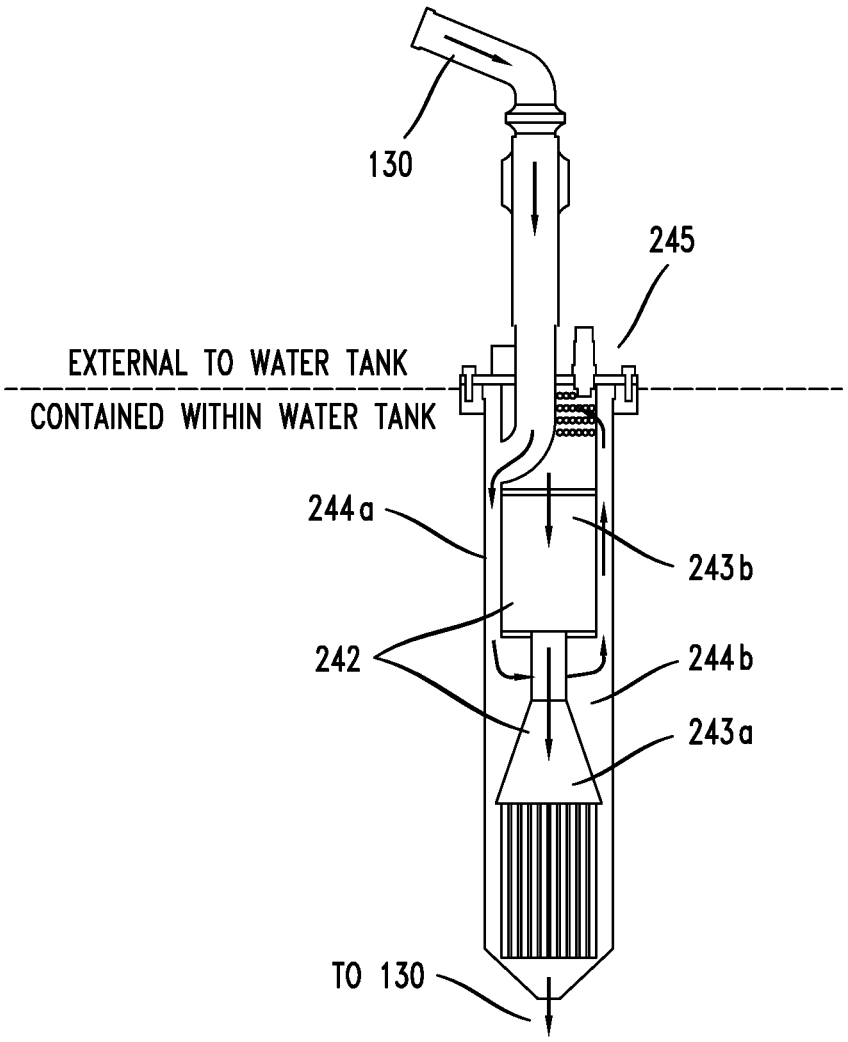
FIG. 6B depicts an alternative, enlarged view of a portion of the exemplary energy generation sub-system shown in FIG. 5 in accordance with another embodiment of the present invention.

Referring now to FIG. 6B, there is depicted an enlarged view of an alternative, exemplary muffler-catalytic converter unit 242. As shown the positions of the muffler 243*b* and converter 243*a* have been reversed versus the positions depicted in FIG. 6A (i.e., top to bottom positions).

As depicted, exhaust may be received from the heat exchanger 130 (e.g., piping) by unit 242 that may be within a vessel, such as vessel 120. The exhaust may enter a first half-annular passage 244*a* which may be formed by the interior surface of the unit 242 and muffler 243*b*. Due to the configuration of the interior of the unit 242, the exhaust may be directed upwards in a loop-back flow via second half-annular passage 244*b*—also formed by the interior surface of the unit 242 and muffler 243*b*—and into the muffler 243*b*. In an embodiment, when the annular passages 244*a,b* are within a unit that is within a vessel that contains liquid at a lower temperature than the exhaust (e.g., water), the exhaust may be cooled via at least convection and/or conduction as it traverses the passages 244*a,b*. It should be noted that the direction of exhaust flow depicted in FIG. 6B is exemplary, (i.e., other configurations that achieve the same flow may be used, such as moving the flow from left to right (which is shown in FIG. 6B) or right to left).

Similar to the discussion above regarding unit 142, in an embodiment, the muffler 243*b* may be operable to reduce a level of sound generated by the engine 128 and exhaust gases, for example, to less than 60 dB. Such sound reduction is desirable in order to place the sub-system 101 within a house or dwelling 200. Said another way, absent the muffler 243*b*, the engine 128 may generate sound at a level that would be irritating to the inhabitants or occupants of the house or dwelling 200. Further sound reduction may be achieved by embedding the muffler 243*b* within a storage vessel (e.g., vessel 120) such that any sound that is not reduced by the muffler 243*b* may be dampened or otherwise reduced by the water within the vessel. In an embodiment the level of sound escaping the vessel 120 may be less than 60 dB, for example. Yet further, because the muffler 243*b* may be configured within a vessel it is less likely to be exposed to conditions (air) that would lead to its corrosion. Thus, it is expected that the useful life of the muffler is lengthened by embedding it within a vessel. In an embodiment, the muffler 243*b* may be made from a stainless steel, for example.

In some embodiments the unit 242 may further comprise an oxygen sensor 245 that may be operable to detect a level of oxygen in the exhaust and send signals to controls (not shown in figures) in order to ensure that a proper stoichiometric balance of treated exhaust is achieved and maintained to ensure appropriate reduction of toxic gases within the exhaust Upon exiting the muffler 243*b* the exhaust may flow to a catalytic converter section 243*a* that may be operable to convert toxic gases (e.g. oxides of nitrogen (NOx), carbon monoxide) in the exhaust to substantially non-toxic gases (nitrogen, hydrocarbons, carbon dioxide) as well as convert the exhaust into additional heat that may be absorbed by the water 120*a* in the vessel 120 surrounding the converter 243*a*. In an embodiment, section 243*a* may comprise a ceramic structure having layers coated with one or more of a metal catalyst, such as platinum, rhodium and/or palladium, for example. As exhaust enters converter 243*a*, it may impact a first so-called "reduction" layer comprising platinum and rhodium. This layer functions to reduce NOx in the exhaust by converting NO or NO2 molecules in the exhaust to nitrogen. Thereafter, the exhaust may impact a second or "oxidation" layer comprising palladium or platinum that functions to reduce unburned hydrocarbons and carbon monoxide through oxidization (burning) to carbon dioxide and water, for example.

In an embodiment, the converter 243*a* may be configured as honeycombed layers or layers of ceramic beads, for example.

As mentioned previously the unit 242 may be within the vessel 120 in order to transfer heat to the water 120*a* in order to capture energy in the form of heat from the exhaust and components of unit 242. It should be noted that when the converter 243*a* is so located, the temperature of the converter 243*a* may eventually equal the temperature of the water 120*a* inside the vessel 120. In an embodiment, this allows the converter 243*a* to be more efficient than existing converters. In more detail, during operation of the engine 128 the temperature of the water 120*a* in the vessel 120 may be in the range of 100° to 160° F. Accordingly, the converter 243*a* will be at the same temperature at some point (or, at least a higher temperature than ambient). In an embodiment, the converter 243*a* may be operable to reach an optimum operating performance once it has reached an optimum operating temperature. Accordingly, because the temperature of converter 243*a* may be maintained at an elevated temperature the converter 243*a* may reach (and maintain) an optimum operating temperature more quickly than converters that are not so located. In an embodiment, because the converter 243*a* can operate at an optimum operating temperature it may be able to more effectively remove toxic gases and elements from the exhaust within piping 130.

In an embodiment, the unit 242 may be configured to be easily replaceable. For example, in one embodiment the unit 242 may be replaced by removing some or all of the exhaust heat exchanger 130 and lifting the unit 242 out of the sub-system 101.

Continuing, upon being treated by the unit 142 or 242 the exhaust may flow to the exhaust heat exchanger 130 that may be operable to transfer heat within the exhaust gases to water 120*a* within the vessel 120. In an embodiment the heat exchanger 130 may comprise a plurality of coiled piping (i.e., coils) that are embedded in water 120*a* within vessel 120. The coils 130 may comprise a thermally conductive material, such as stainless steel, for example.

In an embodiment, as the heated exhaust flows through coils 130 it heats the coils 130 which in turn heat the surrounding water 120*a*. Thus, heat is transferred from the exhaust into the water 120*a*. Thus, the sub-system 101 can be said to capture energy in the form of heat that would ordinarily have been lost if the exhaust was simply discharged to the atmosphere outside of the dwelling or house 200. The water 120*a* that has been heated may be used as hot water for inhabitants (via plumbing and appliances) of the dwelling or house 200.

FIG. 5 further depicts exhaust output piping 120*b* and an exhaust condensation drain 120*c*. In an embodiment, after the exhaust exits the coils 130 it may enter the piping 120*b* and be safely expelled or otherwise output to the atmosphere or environment exterior to the dwelling or house 200. As the exhaust traverses the piping 120*b* it may undergo additional cooling. Accordingly, some of the gases within the exhaust may be converted to a liquid and flow back down the piping 120*b* towards the bottom of the piping 120*b*. In an embodiment, the piping 120*b* and drain 120*c* may be configured to allow such liquid to escape the bottom of piping 120*b* through drain 120*c*.

As noted previously, the sub-system 101 may be operable to capture heat that would otherwise be wasted from both the exhaust and from the engine coolant. We now turn to a discussion of the later.

Referring back to FIG. 5, sub-system 101 may further comprise a pump (not shown, but may be located at position 132*a*) that may be operable to provide a coolant (e.g., water) at a desired temperature and pressure to the engine 128 as part of an engine cooling system described herein.

As the coolant absorbs heat from the engine 128, the coolant flows away from the engine 128 via coolant heat exchanger 134 (e.g. coiled piping or coils) that may be operable to transfer heat from the coolant to the liquid 120*a* within the vessel 120. In an embodiment, coils 134 may comprise an exemplary, thermally conductive material, such as stainless steel.

Similar to coils 130, as heated coolant flows through coils 134 it heats the coils 134 which in turn heat the surrounding liquid 120*a*. Thus, heat is transferred from the coolant into the water 120*a*. Thus, once again the sub-system 101 can be said to capture energy in the form of heat that would ordinarily have been lost if the heat from the coolant was simply discharged. The water 120*a* that has been heated may be used as hot water for inhabitants (via plumbing and appliances) of the dwelling or house 200.

Once the coolant has travelled through the entire set of coils 132 it may enter the pump (not shown, but may be located at position 132*a*) prior to being re-introduced into the engine 128.

Accordingly, the sub-system 101 captures or recovers heat from both the exhaust and coolant.

Backtracking somewhat, the sub-system 101 depicted in FIG. 5 may further include additional features that make the sub-system 101 highly efficient and/or substantially noise free. For example, as shown the sub-system 101 may further comprise thermo-acoustic insulation 144 (e.g., insulating foam) configured inside the internal surface of the top section or cowling 101*a* of sub-system 101. In an embodiment, the cowling 101*a* may be configured to cover the top and sides of the engine 128 and functions to prevent outside contaminants from interfering with the operation of the engine 128. In addition, the insulation 144 functions to absorb or otherwise prevent sounds emanating from inside the cowling 101*a* due to, for example, operation of the engine 128, from escaping the cowling 101*a* and causing irritation to inhabitants of the dwelling or house 200 in which the sub-system 101 is installed. Yet further, the insulation 144 functions to prevent air 121*b* within the cowling from escaping, and instead the air 121*b* is drawn into the engine 128 through air intake section 113*b*. In an embodiment, the air intake section 113*b* may comprise a filter (not shown) that functions to remove contaminants in the air that might otherwise cause the engine 128 to malfunction if the contaminants were not so removed. As depicted in FIG. 5, the air intake section 113*b* may be positioned so that external air 121*c* from outside the sub-system 101 that is drawn into the cowling 101*a* through an external make-up air supply section 113*a* (e.g., piping) is first able to flow over the engine 128 and generators 128*a,b* in order to provide additional cooling of the engine 128 and generators 128*a,b* before such, now heated air 121*b* is taking into the intake air section 113*b*. Said another way, rather than position the air intake section 113*b* immediately next to the supply section 113*a*, which would then direct air 121*c* into the engine 128 to be mixed with fuel and combusted, but would make the air 121*c* unavailable to cool the engine 128 and generators 128*a,b* the air intake section 113*b* is positioned at a distance from the supply section 113*a* so that air 121*c* can first flow over the engine 128 and generators 128*a,b*, in effect transferring some of the heat from the engine 128 and generators 128*a,b* into the flowing air. The now heated air 121*b* may then enter the intake section 113*b*. In an embodiment, in addition to positioning the intake air section 113*b* so that external air 121*c* may flow over and cool the engine 128 and generators 128*a,b*, such a position also allows for the air 121*c* to be heated, in effect allowing "pre-heated" air 121*b* to enter the engine 128 via the air intake section 113*b*. The ability to input pre-heated air functions to make combustion of the fuel used by the engine 128 more energy efficient.

As noted above, the supply section 113*a* may comprise piping (e.g., a polyvinyl chloride material, "PVC"). In an embodiment, the openings 113*d* that receive the piping 113*a* (as well as exhaust piping 120*b* which may also comprise PVC) may be sealed using, for example, a gasket and latch configuration. In addition, due to the operation of the engine 128, air in the cowling 101*a* will be drawn into the engine 128 causing a pressure gradient inside the cowling 101*a* to form. In an embodiment, this pressure gradient may prevent leakage of any air from inside the cowling 101*a* to the outside surroundings.

As noted, provided the engine 128 is operating, air within the cowling 101*a* may be drawn from the supply section 113*a*, over the engine 128 and generators 128*a,b* and into the air intake section 113*b*. However, when the engine 128 is not operating (or not operating correctly) a sufficient amount of air may not be drawn into the cowling 101*a* via the supply section 113*a*. Should this situation occur, the temperature and pressure of the air that is already inside the cowling 101*a* that has been heated by the engine 128 may rise to level that may adversely affect the operating efficiency of the engine 128. To mitigate such an affect, in an additional embodiment subsystem 101 may comprise one or more fans 113*c*. In an embodiment, the fans 113*c* may be positioned in-line with the top of the exhaust piping 120*b*, for example. The fans 113*c* may be operable to create a negative pressure in order to draw air out of the cowling 101*a* in order to reduce the affects discussed above thus, allowing the engine 128 to function properly.

The sub-system 101 may include additional components. For example, a fuel injector 128*d* that functions to control the amount of a fuel source that is injected into the engine 128 to be mixed with air intake and an intake air valve train 128*e* are shown in FIG. 5.

As noted previously, the sub-system 104 may be operable to store a first amount of energy. This energy may be used by an inhabitant or occupant of the dwelling or house 200 or, alternatively, be delivered back to an electric utility's grid in return for compensation or credits, for example.

In the later scenario a utility may install controls (not shown in figures) that permit the utility to request and receive energy stored within sub-system 104 as needed. For example, it is known that many utilities must pay (other utilities, or energy source providers) a substantial premium to supply electrical energy to residential and commercial customers during "peak" energy time periods (e.g. when everyone turns their air conditioners on over the same time period during the summer months). This premium may amount to 25% or more of a utilities' yearly cost of providing electricity. In contrast, the embodiments of the present invention when combined with required controls allows such a utility to request and receive additional power from energy storage sub-section 104 instead of another utility at a lower cost.

Still further, embodiments of the invention may lower a utility's cost of producing electricity in yet another way. For example, it is known that a substantial amount of energy from an energy source (coal) is lost between the time the energy source is used by a utility to generate electricity at an operating plant and the time the energy is actually delivered to a remote customer. By some estimates, 65% of the energy generated is lost by the time it is delivered to a customer's traditional heating and electrical system. In comparison, systems provided by the invention, such as system 100, installed at a location 200 where the heat and electricity will be utilized have the capability of delivering approximately 60% more energy than traditional heating and electrical systems.

In the case where an inhabitant or occupant of the dwelling or house 200 desires to make use of any excess energy that is produced by an inventive, combined heat and power systems described or referenced herein the inventors provide numerous designs and modes of operation to realize such a desire. Some of these designs and modes of operation are set forth above. Still others are now described.

Figure 7A:
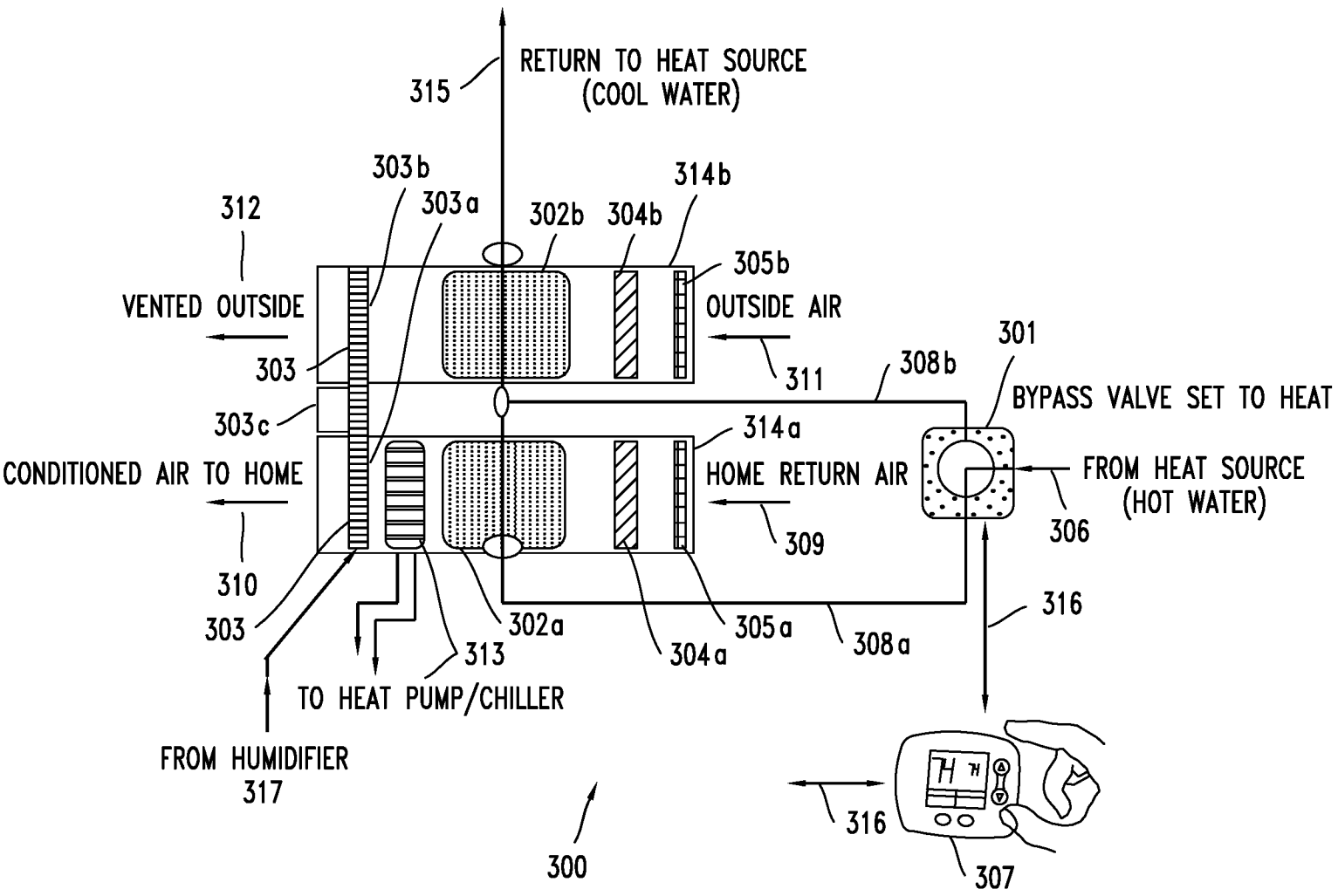
FIGS. 7A and 7B depict heat exchangers, among other components, of a humidity control sub-section according to one or more embodiments of the invention.
Figure 7B:
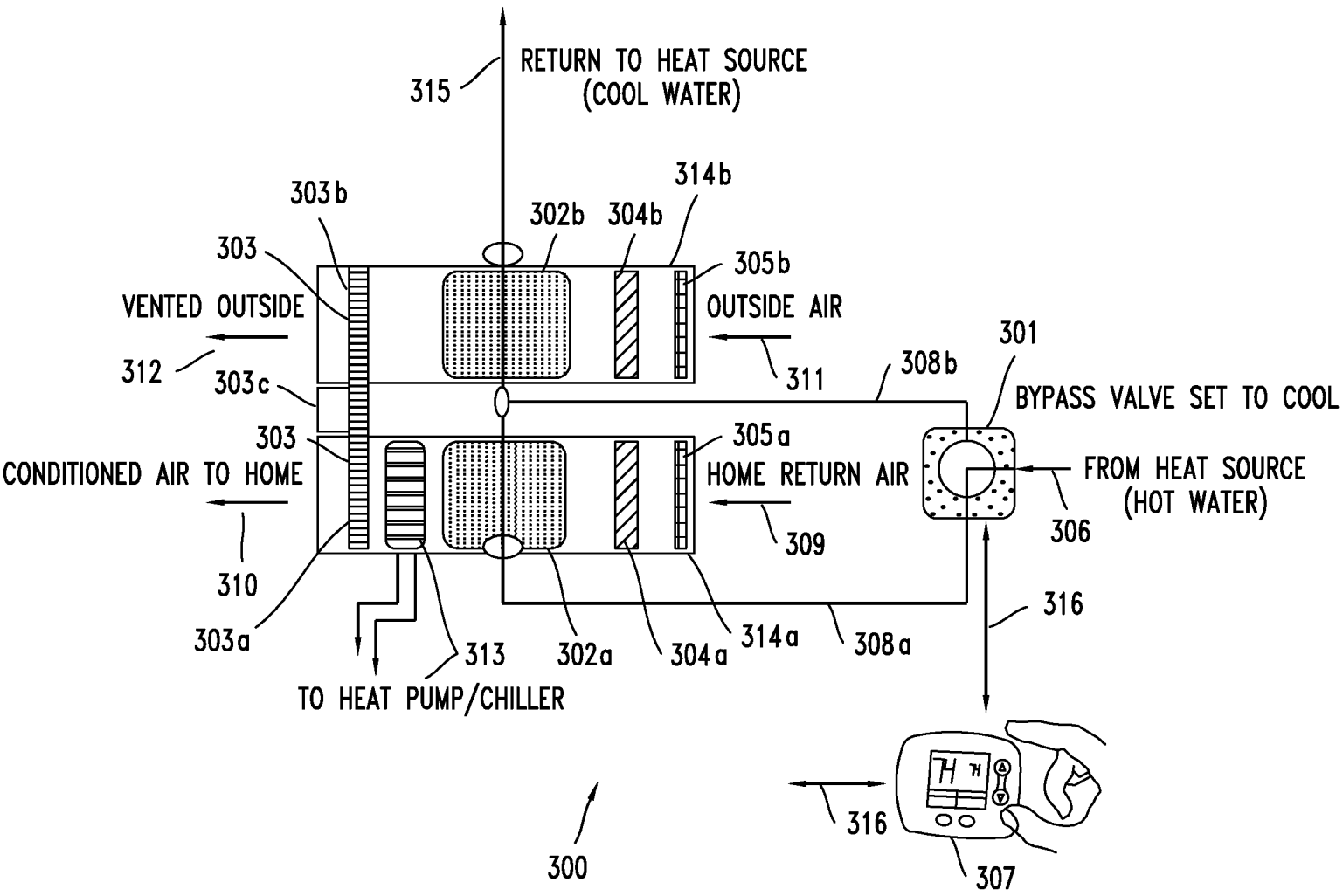

Referring now to FIGS. 7A and 7B there is depicted a humidity control sub-section 300 operable to (i) control temperature and humidity of air circulating within a dwelling or house, such as house/dwelling 200 described previously, based on energy transferred from heated liquid or circulated coolant or (ii) control a discharge of a second amount of energy from heated liquid or circulated coolant.

As noted above, as the inventive combined heat and power systems operate they may generate a substantial amount of excess heat that, in traditional systems would not be used (i.e., it would be wasted). In embodiments of the invention, such waste heat may be captured and then used to reduce the temperature and/or humidity of air circulating within a dwelling or house (e.g., dwelling 200) by the humidity control subsection 300, among other uses. Alternatively, some of the waste heat may be discharge to the atmosphere, for example, by subsection 300.

In one embodiment, subsection 300 may comprise a bypass valve 301 (e.g., a 3-way by-pass valve), first and second external heat exchangers 302*a*, 302*b* (e.g. coils, radiators that are external to, or outside, a water tank or vessel), a humidity control element 303 (e.g., a rotatable desiccant medium 303*a, b*, motors and motor controller 303*c*), fans 304*a*, 304*b*, filters 305*a*, 305*b*, a heat pump 313, a source of moisture 317, and controls 307 described below. In an embodiment, coils within exchangers 302*a*, 302*b* may comprise an exemplary, thermally conductive material, such as stainless steel. The first external heat exchanger 302*a* may be enclosed within a first enclosure 314*a* while the second external heat exchanger 302*b* may be enclosed within a second enclosure 314*b*. Alternatively, the two enclosure 314*a*, 314*b* may be combined into one enclosure if space is needed or further separated into additional enclosures depending on design and/or operating considerations.

In an embodiment controls 307 may be operable to send one or more control signals via wired or wireless channels and means to the humidity control sub-section 300 to control the temperature and/or humidity of the air circulating within the dwelling or house. In embodiments, controls 307 may comprise a temperature sensor, thermostat, smart thermostat, humidity/barometric pressure sensor, a controller or some combination of such components (collectively "controls 307"), for example.

In more detail, controls 307 may be may be operable to detect or sense the temperature and/or humidity of the air within a dwelling or house, such as dwelling or house 200 and then send or transmit (collectively "send") one or more control signals to control the operation of the bypass valve 301 (e.g., a 3-way by-pass valve) via wireless or wired channels and means. Thereafter, by-pass valve 301 may be operable to control the initial flow of heated water or coolant 306, that contains waste heat, to the first or second external heat exchangers 302*a*, 302*b* from an engine and/or, alternatively, from a pressure vessel or tank described elsewhere herein, or from another source of heated water.

Depending on the mode of operation (described in more detail below), the controls 307 may be operable to send one or more control signals via wireless or wired means and channels to control the operation of one or more of the humidity control element 303, fans 304*a*, 304*b*, heat pump 313 and/or the source of moisture 317.

In one embodiment, if the temperature detected by controls 307 indicates that the dwelling or house needs heat (e.g., the temperature is below 65° F.), then the controls 307 may be operable to send one or more control signals via wired or wireless connection 316 to the by-pass valve 301 causing the valve 301 to initially direct the flow of heated water or coolant 306 to the first external heat exchanger 302*a* via piping 308*a*, for example. Alternatively, if the temperature detected by controls 307 indicates that the dwelling or house needs cooling (e.g., the temperature is above 65° F.), then the controls 307 may be operable to send one or more signals via the wired or wireless connection 316 to the bypass valve 301 causing the valve 301 to initially direct the flow of heated water or coolant 306 to the second external heat exchanger 302*b* via piping 308*b*, for example.

Referring more particularly now to FIG. 7A, there is depicted components associated with heating modes in accordance with embodiments of the invention.

In a first heating mode it is desirable to use excess energy (i.e., waste heat) to provide heat to the house or dwelling, but not dehumidification. For example, controls 307 may be operable to detect that the temperature of the dwelling or house may fall below a threshold (e.g., below 65° F.) and, thereafter, send one or more signals to control the fan 304*a* via wired or wireless connections 316 (connection to fans is not shown for ease of understanding the figure) to turn on in order to blow any air that flows over exchanger 302*a* back into the dwelling as heated air 310. In more detail, as the heated water or coolant 306 flows through the exchanger 302*a* it discharges energy (heat) to the air 309 flowing over the exchanger 302*a*. Air 309 may comprise air from conduits or the like (not shown in figures) that has previously circulated through the house (i.e., return air). The discharged energy warms the return air 309 while the fan 304*a* blows the now warmed air 310 back into the house or dwelling. Because controls 307 have detected or sensed an acceptable humidity level, the controls 307 will not send signals to the humidity control element 303 via wired or wireless connection 316 (connection to element 303 is not shown for ease of understanding the figure). It should be noted that the return air 309 may be filtered by filter 305*a* in order to remove dust and particulate (collectively "particulate") that may clog or otherwise decrease the effectiveness of element 303 when utilized (e.g., portion 303*a* of element 303) or may otherwise be unhealthy for the inhabitants of the house or dwelling.

In a second heating mode, controls 307 may detect or sense that both the temperature and humidity of the house or dwelling must be adjusted. For example, controls 307 may detect that the temperature of the dwelling or house has fallen below a threshold (e.g., below 65° F.) and the humidity has exceeded a threshold (e.g., 10%, 20%, 50%). Accordingly, controls 307 may be operable to send one or more signals via wired or wireless connection 316 to control both fans 304*a*, 304*b* and element 303 to turn on (again, specific connections to fans and element 303 are not shown for ease of understanding the figure) as the heated water or coolant 306 flows through both exchangers 302*a*, 302*b*. The heated water 306 within exchangers 302*a*, 302*b* begins to discharge energy to warm the air flowing over them, respectively.

In more detail, upon receiving a signal to turn on via connection 316, the fan 304*b* begins to force air 311 from outside of the house or dwelling through the second filter 305*b* over the second external heat exchanger 302*b* and through a portion 303*b* of the rotatable desiccant medium of element 303 as the medium begins to rotate or otherwise move. As a consequence, the portion 303*b* of the element 303 that is in the path of air that flows over exchanger 302*b* will be warmed and dried (collectively "dried") by air that has been warmed by energy discharged from exchanger 302*b*. As the portion 303*b*, now dried, rotates further it moves into the path of return air 309. Accordingly, the flowing, return air 309 will now flow through now dried portion 303*b*. In an embodiment of the invention, dried portion 303*b* may be operable to remove water vapor from the return air 309, thereby dehumidifying the air 309 (i.e., water vapor is absorbed or removed from the air 309) before it is warmed by energy discharged from exchanger 302*a* and then blown into the house or dwelling as warmed air 310 by fan 304*a*. Of course, as portion 303*b* is rotating portion 303*a* is also rotating into the path of filtered air flowing over exchanger 302*b* due to fan 305*b*. Accordingly, any water vapor collected by portion 303*a* while it was in the path of return air 309 may be removed or absorbed by the air 311 that flows onto portion 303*a* by virtue of the force of air from fan 304*b* after it has been warmed by energy discharged from exchanger 302*b*, thus drying portion 303*a*. Thereafter, as portions 303*a*, 303*b* continue to rotate they each repeat the cycles of drying, water vapor absorption, drying, water vapor absorption, etc., to dehumidify air 310 before it is blown back into the house or dwelling until such time as a motor and/or motor controller 303*c* receives one or more signals from controls 307 via wireless or wired channels and means to cease operation (i.e., stop rotating portions 303*a*, 303*b*).

It should be noted that air 311 may first flow through filter 305*b* to remove particulate before the air 311 flows to portions 303*a*, 303*b* to avoid clogging or otherwise decreasing the effectiveness of portions 303*a*, 303*b*, for example.

In a third mode, heated water or coolant 306 may be used to heat a house or dwelling and, in addition, a second amount of energy from the heated water or coolant 306 may be discharged to the external atmosphere in order to return the heated water or coolant 306 to a water vessel, tank or engine that is part of a combined heat and power system described elsewhere herein. In this embodiment, dehumidification is not required.

Accordingly, controls 307 may be operable to detect that the temperature of the dwelling or house may fall below a threshold (e.g., below 65° F.) and, thereafter, send one or more signals to control the fan 304*a* via connection 316 to turn on. In addition, controls 307 may send one or more similar signals to fan 304*b* via connection 316 to turn on. It should be understood that the physical wired or wireless connection to each component or element of the sub-section 300 from controls 307 may be a distinct connection to each component or element (i.e., the connections are different, but the same indicator "316" in the figures will be used for simplicity of discussion).

In more detail, as the heated water or coolant 306 flows through the first exchanger 302*a* it discharges energy (heat) to the return air 309 flowing over the exchanger 302*a*. The discharged energy warms the air 309 while the fan 304*a* blows the now warmed air 310 back into the house or dwelling. Because controls 307 have detected or sensed an acceptable humidity level, the controls 307 will not send signals to the humidity control element 303 to turn on. As the heated water or coolant 306 flows further to the second exchanger 302*b* external air 311 is forced over the exchanger 302*b* by fan 304*b*. Accordingly, air 311 forced over exchanger 302*b* moves the heat discharged into the air from exchanger 302*b* (i.e., a second amount of energy) away from exchanger 302*b* and to the external atmosphere as air 312.

In a fourth heating mode, a second amount of energy from the heated water or coolant 306 may be discharged to the external atmosphere as air 312 in order to lower the temperature of the heated water or coolant 306 so that it may be returned to a vessel, tank or engine that is part of a combined heat and power system. In this mode, the house or dwelling does not require heat or dehumidification.

Accordingly, controls 307 may be operable to detect that the temperature and humidity of the house are within acceptable thresholds so controls 307 will not send signals to components in sub-section 300 to turn on. Nonetheless, some of the waste heat must still be discharged. In this mode, controls, such as controls 15 described earlier, may send one or more signals to components of sub-section 300 to control a discharge of the second amount of energy from the heated liquid or circulated coolant in order to ultimately control the temperature and pressure of water in a tank, vessel or boiler, for example (for ease of understanding the wired or wireless connections between controls 15 and components of the subsection 300 are not shown for ease of understanding).

More particularly, controls 15 may send one or more signals to control fan 304*b* to turn on. Thus, as the heated water or coolant 306 flows through the first exchanger 302*a* it discharges energy (heat) to warm the return air 309 flowing over the exchanger 302*a*. However, because the fan 304*a* has not received a signal to turn on, little or no energy from exchanger 302*a* will be discharged from the heated water or coolant 306 within exchanger 302*a* to the air 309. Thus, little or no warmed air 310 will flow back into the house or dwelling. As the heated water or coolant 306 flows further to the second exchanger 302*b*, external air 311 is forced over the exchanger 302*b* by fan 304*b*. Accordingly, air 311 forced over exchanger 302*b* moves the heat discharged from exchanger 302*b* (i.e., a second amount of energy) away from exchanger 302*b* and to the external atmosphere as air 312. As a result, the temperature of the water or coolant 306 within exchanger 302*b* is reduced before it is returned to a tank, vessel or boiler, for example, via piping 315, for example.

In a fifth mode the source of moisture 317 (e.g., a humidifier) may be operable to provide moisture (e.g. water vapor) to subsection 300. In particular, controls 307 may be operable to send one or more signals to source 317 via wired or wireless means and channels to turn on in order to add moisture to element 303. The added moisture in turn adds moisture to the air 310 that is directed and circulated back into the house or dwelling to humidify the air 310.

In yet another mode, the humidity control sub-section 300 is not utilized because the dwelling or house does not need heat and the temperature of water in a tank, vessel or boiler is acceptable.

So far the discussion has focused mainly on providing heat to a house or dwelling. However, sub-section 300 may also be used to provide cooling to a house or dwelling.

Referring now to FIG. 7B there is depicted components associated with exemplary cooling modes in accordance with embodiments of the present invention. As mentioned previously, to provide cooling to a house or dwelling controls 307 may send signals to a by-pass valve, such as valve 301 via wired or wireless connection 316, to control the by-pass valve in order to allow heated water or coolant 306 to initially flow to the second external heat exchanger 302*b*. Accordingly, little or no heated water or coolant 306 flows through the first external heat exchanger 302*a*. Rather, substantially all of the water or coolant 306 flows to the second heat exchanger 302*b*.

In a first cooling mode, the house or dwelling requires cooling and dehumidifying. For example, controls 307 may detect or sense that the temperature and humidity of the house or dwelling has exceeded or met a threshold (e.g., the temperature is above 65° F., and the humidity is above 10%, 20%, 50%, etc.). Accordingly, in an embodiment, controls 307 may be operable to send one or more signals to control fans 304*a*, 304*b*, humidity control element 303 (e.g., a rotatable desiccant medium 303*a,b*,) and heat pump 313 via wired or wireless connections 316 to turn on. Because no heated water or coolant 306 is flowing through the first external heat exchanger 302*a* the air 309 returning from the house or dwelling will instead be cooled by the heat pump 313 as the air 309 passes over coils of the heat pump 313, for example. Thereafter, the cooled air 310 will be blown back into the house or dwelling. In addition to cooling the air 310, the air 310 will also be dehumidified.

In one embodiment, as fan 304*b* begins to operate it forces air 311 from outside of the house or dwelling through second filter 305*b*, over the second external heat exchanger 302*b* and through a portion 303*b* of the rotatable desiccant medium of element 303 as the medium begins to rotate or otherwise move. As a consequence, the portion 303*b* that is in the path of air that flows over exchanger 302*b* will be dried due to the fact that the air 311 receives energy discharged as heat from exchanger 302*b*. As the portion 303*b*, now dried, rotates further it moves into the path of air 309 that is being cooled by the heat pump 313. Accordingly, the air 309 will now flow through now dried portion 303*b* of element 303. In an embodiment of the invention, the dried portion 303*b* may be operable to absorb or remove water vapor from the air 309, thereby dehumidifying the air 309 before it is blown into the house or dwelling as cooled, dehumidified air 310. Of course, as portion 303*b* is rotating portion 303*a* is also rotating into the path of filtered air flowing over exchanger 302*b*. Accordingly, any water vapor collected by portion 303*a* due to the time it spent in the path of return air 309 is removed by drying (e.g., evaporation). Thereafter, as portions 303*a*, 303*b* continue to rotate they each repeat the cycles of drying, water vapor absorption, drying, water vapor absorption, etc., to dehumidify air 310 before it is blown back into the house or dwelling until such time as a motor and/or motor controller 303*c* receives one or more signals via wired or wireless connection 316 from controls 307 to cease operation (i.e., stop rotating) because the humidity level has dropped below a selected threshold, for example.

It should be noted that external air 311 may first flow through filter 305*b* to remove particulate before it flows to portions 303*a*, 303*b* to avoid clogging or otherwise decreasing the effectiveness of portions 303*a*, 303*b*.

There may be instances when the humidity of the dwelling or house is acceptable, but the temperature is not. At the same time, the temperature of the water or coolant 306 used by a combined heat and power system may need to be lowered. Accordingly, in a second cooling mode, air that is returned to a house or dwelling is cooled but not dehumidified while the temperature of water or coolant 306 is lowered.

In an embodiment, controls 307 may detect or sense that the temperature of the house or dwelling is above a threshold (e.g., 65° F.). In such a scenario controls 307 may further send one or more signals to control fans 304*a*, 304*b* and heat pump 313 via wired or wireless connection 316 to turn on (the humidity control element 303 is not turned on). Similar to the examples above, because no heated water or coolant 306 is flowing through the first external heat exchanger 302*a* the return air 309 will be cooled by the heat pump 313 as the air 309 passes over coils of pump 313, for example. Thereafter, the cooled air 310 will be blown back into the house or dwelling. In addition, heat from the water or coolant 306 flowing within the second exchanger 302*b* may be discharged (i.e., a second amount of energy) by the action of the air 311 being blown over exchanger 302*b* by fan 304*b*. That is, as the air 311 is forced over the exchanger 302*b* heat discharged from the exchanger 302*b* is removed, and exits as air 312 to the atmosphere, thereby lowering the temperature of the water or coolant 306 within exchanger 302*b* before the water or coolant 306 is fed back to a vessel, tank, boiler or engine, for example, via piping 315.

In a third cooling mode the humidity of the dwelling or house is acceptable, but the temperature is not. Accordingly, in this mode, air that is returned to a house or dwelling is cooled but not dehumidified. Further, in this mode the temperature of the water or coolant 306 used by a combined heat and power system is acceptable, and, thus, does need to be lowered.

In an embodiment, controls 307 may detect or sense that the temperature of the house or dwelling is above a threshold (e.g., 65° F.). In such a scenario controls 307 may be operable to send one or more signals to control fans 304*a* and heat pump 313 to turn on via connection 316 (the other fan 304*b* and humidity control element 303 are not turned on). Again, because no heated water or coolant 306 is flowing through the first external heat exchanger 302*a* the return air 309 will be cooled by the heat pump 313 as the air 309 passes over coils, for example, of the heat pump 313. Thereafter, the cooled air 310 will be blown back into the house or dwelling. The water or coolant 306 will flow through the second exchanger 302*b* and continue back to the vessel, tank, boiler or engine of a combined heat and power system, for example via piping 315.

There may be scenarios where cooling may not be necessary, but where it is desirable to dehumidify the air 309 before it returns to a house or dwelling.

In a fourth mode air 310 that is returned to a house or dwelling is not cooled but is dehumidified.

For example, in such an embodiment controls 307 may detect or sense that the humidity of the house or dwelling is above a threshold as set forth previously herein. In such a scenario controls 307 may send one or more signals to control the dehumidifying control element 303 and fans 304*a*, 304*b* to turn on via connection 316 (heat pump 313 is not turned on).

As fan 304*a* begins to operate it forces return air 309 over first external heat exchanger 302*a*. Because, however, there is no water or coolant flowing within exchanger 302*a*, exchanger 302*a* does not appreciably affect the humidity or temperature of the air 309. However, the humidity of the air 309 is affected by operation of the second heat exchanger 302*b*, element 303 and fans 304*a*, 304*b*. For example, as fan 304*b* forces air 311 over exchanger 302*b* the air 311 receives energy discharged from exchanger 302*b*. The warmed air now flows to portion 303*b* of element 303 and dries portion 303*b*. As portion 303*b*, now dried, rotates it moves into the path of air 309 that is being forced back into the house or dwelling by fan 304*a*. Accordingly, the air 309 will now flow through now dried portion 303*b*. In an embodiment of the invention, the dried portion 303*b* may be operable to absorb or remove water vapor from the air 309, thereby dehumidifying the air 309 before it is blown into the house or dwelling as dehumidified air 310. Of course, as portion 303*b* is rotating portion 303*a* is also rotating into the path of filtered air flowing over exchanger 302*b*. Accordingly, any water vapor absorbed by portion 303*a* due to the time it spent within the path of return air 309 may also be removed by drying (evaporation). Thereafter, as portions 303*a*, 303*b* continue to rotate they each repeat the cycles of drying, water vapor absorption, drying, water vapor absorption, etc., to dehumidify air 310 before it is blown back into the house or dwelling until such time as a motor and/or motor controller 303*c* within element 303 receives a signal from controls 307 via connection 316 to cease operation (i.e., stop rotating elements 303*a*, 303*b*) because the humidity level has dropped below a selected threshold, for example.

In a fifth mode where water or coolant 306 is being fed to the second external heat exchanger 302*b* there may be no need to alter the temperature or humidity of the air 309, but, nonetheless there may be need to discharge energy from the water or coolant 306 in order to lower the temperature of the heated water or coolant 306 so that it may be returned to a vessel, tank or engine that is part of a combined heat and power system via piping 315, for example.

Accordingly, controls 307 may be operable to detect that the temperature and humidity of the house are within acceptable thresholds so controls 307 will not send signals to components in sub-section 300. Nonetheless some of the waste heat must still be discharged. In this mode, controls 15 described earlier, may send one or more signals to components of sub-section 300 to turn them on (the connections to controls 15 and components of sub-section 300 are not shown for the sake of clarity) to help discharge waste heat in water or coolant 306 (i.e., a second amount of energy) in order control the temperature and pressure of water in a tank, vessel or boiler, for example.

More particularly, controls 15 may send one or more signals to fan 304*b* to turn on. Thus, as the heated water or coolant 306 flows through the second exchanger 302*b* it discharges energy (heat) to the air 311 flowing over the exchanger 302*b* by operation of fan 304*b*. Accordingly, air 311 forced over exchanger 302*b* moves the heat discharged from exchanger 302*b* away from exchanger 302*b* and to the external atmosphere as air 312. As a result, the temperature of the water or coolant 306 within exchanger 302*b* may be reduced before it is returned to a tank, vessel, boiler, or engine, for example via piping 315.

In yet a sixth mode, the house or dwelling desires to keep air 309 circulating but without the need for any cooling or dehumidification. Nor is there a need to discharge any energy (heat) from the water or coolant 306 before it is re-used by a tank, vessel, boiler or engine.

Accordingly, controls 307 may be operable to detect or sense that the temperature and humidity of the house are within acceptable thresholds. Further, controls 15 may also be operable to detect or sense that the temperature and pressure of water within a tank, vessel, boiler or engine cooling system is also acceptable. Nonetheless, the inhabitants or occupants of a house or dwelling may desire some amount of air circulation. Thus, in this mode either controls 307, or controls 15 or other controls may be operable to send one or more signals to fan 304*a* of sub-section 300 to maintain some level of circulation of air 309 (again, the connection to fan 304*a* is not shown for the sake of clarity).

More particularly, in one embodiment controls 307 or 15 may send one or more signals to fan 304*a* to turn on, thus forcing return air 309 back into the house as air 310. Because no water or coolant 306 is flowing through first heat exchanger 302*a*, little or no heat will be discharged from the water or coolant 306 within exchanger 302*a* into the moving air 309. Further, because neither the heat pump 313 nor humidity control element 303 is turned on, the air 309 will not be cooled or dehumidified. As a result, the air 309 will continue to be re-circulated to the house or dwelling as air 310 using the fan 304*a* in sub-section 300. This may be referred to as a "fan-only" mode.

In yet a seventh mode, the humidity control sub-section 300 is not utilized because a dwelling or house does not need cooling and the temperature of water in a tank, vessel or boiler is acceptable.

It should be understood that regardless of the heating or cooling mode utilized, after the water or coolant 306 passes through one or more of the external heat exchangers 302*a*, 302*b* the water or coolant 306 is directed to a vessel, tank, boiler or engine cooling system, for example, via piping 315.

It should be understood that the preceding is merely a detailed description of various embodiments of the invention and that numerous changes to the disclosed embodiments can be made in accordance with the disclosure herein without departing from the scope of the invention. The preceding description, therefore, is not meant to limit the scope of the invention. Rather, the scope of the invention is to be determined only by the appended claims and their equivalents.

The invention claimed is:

1. A combined heating and power system comprising:

an energy generation sub-system comprising;

a replaceable engine connected to one or more generators and a turbo-generator, the engine and one or more generators configured to generate energy in the form of electricity, heat and exhaust gases, and provide a first amount of the energy to an energy storage sub-system, and a vessel for storing liquid heated by the heat from the engine and one or more generators;

an energy distribution sub-system comprising;

coils configured to circulate coolant heated by energy from the energy generation sub-system, and fans configured to direct air over heated coils to heat the directed air, and to distribute the heated air throughout a house or dwelling;

a humidity control sub-section configured to (i) control temperature and humidity of air circulating within the dwelling or house based on energy transferred from the heated liquid or circulated coolant or (ii) control a discharge of a second amount of the energy from the heated liquid or circulated coolant; and a controller configured to send one or more control signals to the humidity control sub-section to control the temperature or humidity of the air circulating within the dwelling or house.

2. The system as in claim 1 wherein the humidity control sub-section comprises a by-pass valve, first and second external heat exchangers, a humidity control element, one or more fans and a heat pump.

3. The system as in claim 1 wherein the control is further configured to send one or more control signals to the humidity control sub-section to control the temperature and humidity of the air circulating within the dwelling or house based on the energy transferred from the heated liquid or circulated coolant.

4. The system as in claim 1 wherein the control is further configured to send one or more control signals to the humidity control sub-section to control a discharge of the second amount of energy from the heated liquid or circulated coolant.

5. The system as in claim 1 wherein the control is further configured to send one or more control signals to a by-pass valve to control the by-pass in order to initially direct the heated liquid or circulated coolant to a first or second external heat exchanger.

6. The system as in claim 1 wherein the control is further configured to send one or more control signals to control a humidity control element.

7. The system as in claim 1 wherein the control is further configured to send one or more control signals to control one or more fans and a heat pump.

8. The system as in claim 1 further comprising an energy storage sub-system configured to receive and store the first amount of the energy.

9. The system as in claim 8 wherein the energy storage sub-system comprises a battery configured to discharge stored energy to the energy distribution sub-system or to an electrical utility grid.

10. A method for heating and generating power comprising:

generating electricity, heat and exhaust gases from an energy generation sub-system comprising a replaceable engine connected to one or more generators and a turbo-generator, and providing a first amount of the energy to an energy storage sub-system;

storing liquid heated by the heat from the engine and one or more generators in a vessel;

circulating coolant heated by energy from the energy generation sub-system using coils;

directing air over heated coils to heat the directed air, and to distribute the heated air throughout a house or dwelling;

controlling a temperature or humidity of air circulating within the dwelling or house based on energy transferred from the heated liquid or circulated coolant or controlling a discharge of a second amount of the energy from the heated liquid or circulated coolant; and sending one or more control signals via a controller to the humidity control sub-section to control the temperature or humidity of the air circulating within the dwelling or house based on the energy transferred from the heated liquid or circulated coolant.

11. The method as in claim 10 further comprising sending one or more control signals to the humidity control sub-section to control the temperature and humidity of the air circulating within the dwelling or house based on the energy transferred from the heated liquid or circulated coolant.

12. The method as in claim 10 further comprising sending one or more control signals to the humidity control sub-section to control the discharge of the second amount of energy from the heated liquid or circulated coolant.

13. The method as in claim 10 further comprising sending one or more control signals to a by-pass valve to control the by-pass in order to initially direct the heated liquid or circulated coolant to a first or second external heat exchanger.

14. The method as in claim 10 further comprising sending one or more control signals to control a humidity control element.

15. The method as in claim 10 further comprising sending one or more control signals to one or more fans and a heat pump.

16. The method as in claim 10 further comprising:

receiving and storing the first amount of energy in an energy storage sub-system.

17. The method as in claim 16 wherein the energy storage sub-system comprises a battery, and the method further comprises discharging stored energy from the battery to the energy distribution sub system or to an electrical utility grid.

18. The method as in claim 10 further comprising adding moisture to the air circulating within a dwelling or house to humidify the air.

* * * * *